US005573880A

United States Patent [19]

Mayama et al.

[11] Patent Number: 5,573,880

[45] Date of Patent: Nov. 12, 1996

[54] CARRIER FOR ELECTROPHOTOGRAPHY, PROCESS FOR ITS PRODUCTION, TWO-COMPONENT TYPE DEVELOPER, AND IMAGE FORMING METHOD

[75] Inventors: Shinya Mayama, Yamato; Takeshi Ikeda; Yuko Sato, both of Kawasaki; Yoshinobu Baba, Yokohama; Hiroshi Aoto; Yasuko Hayashi, both of Kawasaki; Hitoshi Itabashi; Yuzo Tokunaga, both of Yokohama, all of Japan

[73] Assignee: Canon Kabushiki Kaisha, Tokyo, Japan

[21] Appl. No.: 363,959

[22] Filed: Dec. 27, 1994

[30] Foreign Application Priority Data

| | | | |
|---|---|---|---|
| Dec. 29, 1993 | [JP] | Japan | 5-351644 |
| Dec. 29, 1993 | [JP] | Japan | 5-351645 |
| Dec. 29, 1993 | [JP] | Japan | 5-351646 |
| Dec. 14, 1994 | [JP] | Japan | 6-332405 |

[51] Int. Cl.[6] ..... G03G 9/10

[52] U.S. Cl. ..... 430/106.6; 430/108

[58] Field of Search ..... 430/108, 106, 430/110, 106.6

[56] References Cited

U.S. PATENT DOCUMENTS

| | | | |
|---|---|---|---|
| 2,297,691 | 10/1942 | Carlson . | |
| 3,507,686 | 4/1970 | Hagenbach | 117/100 |
| 4,977,054 | 12/1990 | Honjo et al. | 430/108 |
| 5,079,124 | 1/1992 | Kawata et al. | 430/108 |
| 5,204,204 | 4/1993 | Shintani et al. | 430/108 |
| 5,340,677 | 8/1994 | Baba et al. | 430/106.6 |
| 5,439,771 | 8/1995 | Baba et al. | 430/108 |

FOREIGN PATENT DOCUMENTS

| | | |
|---|---|---|
| 0351712 | 1/1990 | European Pat. Off. . |
| 0513578 | 11/1992 | European Pat. Off. . |
| 0580135 | 1/1994 | European Pat. Off. . |
| 0584555 | 3/1994 | European Pat. Off. . |
| 42-23910 | 11/1967 | Japan . |
| 43-24748 | 10/1968 | Japan . |
| 47-20755 | 9/1972 | Japan . |
| 48-94442 | 12/1973 | Japan . |
| 56-97354 | 8/1981 | Japan . |
| 56-113146 | 9/1981 | Japan . |
| 58-21750 | 2/1983 | Japan . |
| 58-202457 | 11/1983 | Japan . |
| 59-104663 | 6/1984 | Japan . |
| 59-33911 | 8/1984 | Japan . |
| 60-131549 | 7/1985 | Japan . |
| 61-149296 | 7/1986 | Japan . |
| 3-140969 | 6/1991 | Japan . |

*Primary Examiner*—John Goodrow

*Attorney, Agent, or Firm*—Fitzpatrick, Cella, Harper & Scinto

[57] ABSTRACT

A carrier for use in electrophotography has carrier particles. The carrier particles each comprise a carrier core particle and a resin for coating the carrier core particle and having a resistivity of $10^{10}$ Ω·cm or above under conditions of a temperature of 23° C. and a humidity of 50% RH. The carrier particles have an average particle diameter of not larger than 100 μm and a resistivity of $10^{10}$ Ω·cm or above. The carrier particles comprise not less than 80% by number of resin-coated carrier particles whose carrier core particles are each coated with a resin in a coverage of not less than 90%.

65 Claims, 3 Drawing Sheets

CARRIER FOR ELECTROPHOTOGRAPHY, PROCESS FOR ITS PRODUCTION, TWO-COMPONENT TYPE DEVELOPER, AND IMAGE FORMING METHOD

BACKGROUND OF THE INVENTION

1. Field of the Invention

The present invention relates to a carrier for electrophotography, a process for producing the carrier, a two-component type developer having the carrier and a toner, and an image forming method.

2. Related Background Art

A variety of methods are known for electrophotography, as disclosed in U.S. Pat. No. 2,297,691, Japanese Patent Publications No. 42-23910 and No. 43-24748 and so forth. In these methods, a photoconductive layer is imagewise exposed to light, corresponding to an original to form thereon an electrostatic image. Then, in the case of normal development, a toner having a polarity opposite to that of the electrostatic image is caused to adhere thereto to develop the electrostatic latent image. Next, the toner image formed is transferred to a transfer medium such as paper if necessary, followed by fixing by the action of heat, pressure, heat-and-pressure or solvent vapor. Thus, a copy is obtained.

In the step of developing the electrostatic image, an electrostatic mutual action between charged toner particles and the electrostatic image is utilized to form the toner image on the electrostatic image. In general, among methods of developing such electrostatic images by the use of toners, two-component type developers prepared by blending toner particles and carrier particles are preferably used in full-color copying machines required to achieve an especially high image quality.

The carrier particles that constitute the two-component type developers can be roughly grouped into conductive carriers and insulative carriers. The conductive carriers are usually comprised of oxidized or unoxidized iron powder. Two-component type developers comprised of such iron powder have had the problems that their triboelectric chargeability to toner is unstable, and charges on a photosensitive drum may leak because of the use of conductive carriers to cause a lowering of image quality, or carrier adhesion may occur because of charges injected from the conductive carrier into a photosensitive member, to cause carrier adhesion at non-image areas. Such problems especially occur especially when carrier cores are made to have a lower magnetic force in order to obtain copy images with a high image quality and a high vividness, which also cause a lowering of image quality, and hence it has been unsuitable for the conductive carriers to be used in electrophotographic processes for forming copy images with a high image quality and a high vividness.

The insulative carriers are commonly typified by a resin-coated carrier comprising carrier core particles comprised of a ferromagnetic material such as iron, nickel or ferrite, or magnetic material disperse type resin cope particles prepared by dispersing magnetic fine particles in a resin, and whose surfaces are coated with an insulating resin.

It is true that as disclosed in Japanese Patent Application Laid-open No. 58-21750 the coating of core particles brings about an improvement in longevity properties, impact resistance, resistance values and breakdown resistance to applied voltage, but it is very difficult to bring the resistivity of carriers to a proper value and also to uniformly control the state of coating.

In the case of the magnetic material disperse type resin carriers, faulty coating may cause fall-off of magnetic fine particles from carrier particles surfaces, and also may cause partial charge-up of carriers, bringing about the problem that, especially in a developing system of applying an alternating electric field in order to make image quality higher, its electrostatic force tends to cause carrier adhesion.

In the developing process where a high-frequency alternating electric field is applied, as required especially in high-speed electrophotographic copying machines and when images are formed in a high image quality and a high vividness, the above resin-coated insulating carrier may cause carrier charge-up as a result of accumulation of charged components produced on the surfaces when it comes into friction with other carrier particles and toner particles in a developing assembly, to cause a great variation of development efficiency, so that the image density may increase as a result of running or the triboelectric chargeability may become lower to cause in-machine toner scatter. The carrier charge-up may remarkably occur especially in an environment of low temperature and low humidity, often bringing about problems.

As a means for making improvements from such aspects, it is proposed to use a medium-resistance material as a carrier coat agent. It is true that the used of the medium-resistance material as a carrier coat agent brings about an improvement in regard to the problem caused along the phenomenon of charge-up occurring during a high-speed process or in a high-frequency alternating electric field, but such materials have caused problems in that the image quality deteriorates because of the disorder of electrostatic images and the charge injection from developing sleeves into carriers causes the phenomenon of carrier adhesion.

In recent years, with a progress in computers, high-vision systems and so forth, there is a demand for more highly minute full-color image output means. To this end, efforts have been made so that full-color images can have image quality and vividness higher enough to achieve a high quality comparable to the level of image quality of silver salt photographs. In answer to such a demand, studies are made from various directions or perspectives, such as processes, materials and so forth. For example, from the viewpoint of electrophotographic processing, there can be methods of converting the analog processing of images into digital processing, or applying an alternating bias during development to vibrate developing (magnetic) brushes. From the perspective of developers, there is a method of making carrier and toner particle diameters smaller.

Based on detailed studies of electrophotographic processing, there is a possibility that a higher image quality can be achieved by densifying the developing (magnetic) brush on a developing sleeve. The developing brush can be made dense by decreasing the magnetic force of carrier particles used.

It has been hitherto studied to decrease magnetic properties of carriers. For example, Japanese Patent Application Laid-open No. 59-104663 discloses a method in which a magnetic carrier having a small saturation magnetization is used. Although the use of carrier having a small saturation magnetization can bring about an improvement in fine-line reproduction, it, on the other hand, causes a decrease in the force of binding carrier particles onto the developing sleeve, to tend to cause the phenomenon of carrier adhesion where magnetic carrier particles transfer to the photosensitive drum to cause faulty images.

The phenomenon of carrier adhesion is known to tend to occur also because of the use of magnetic carriers with a small particle diameter. For example, Japanese Patent Application Laid-open No. 60-131549 discloses a method in which images are formed using a magnetic carrier and a toner which have been made to comprise fine particles. This publication discloses that, in order to better prevent carrier adhesion in a developing process where a vibrating electric field is applied, it is effective to make carriers have a high resistivity.

However, even if the bulk resistivity of carriers is made higher in order to prevent carrier adhesion, this has been unsatisfactory in some instances in order to better prevent carrier adhesion and achieve a higher image quality.

To obtain coated carriers, various methods are known as disclosed, for example, in Japanese Patent Publication No. 47-20755, Japanese Patent Application Laid-open No. 48-94442, Japanese Patent Publication No. 54-97354, Japanese Patent Applications Laid-open No. 56-97354, No. 56-113146, No. 58-202457 and No. 58-202457, Japanese Patent Publication No. 59-33911, Japanese Patent Applications Laid-open No. 61-149296 and No. 3-140969, etc. However, it has been long sought to provide a developer that can form toner images free of carrier adhesion and with a high image quality.

As discussed above, in order to make image quality higher, it has been long sought to provide a carrier that can solve the above problems.

SUMMARY OF THE INVENTION

An object of the present invention is to provide a carrier for electrophotography and a two-component type developer for electrophotography, having solved the problems discussed above.

Another object of the present invention is to provide a carrier for electrophotography and a two-component type developer for electrophotography, that can provide full-color copy images having a high image quality and a high vividness.

Still another object of the present invention is to provide a carrier for electrophotography and a two-component type developer for electrophotography, that may cause no carrier adhesion or may cause only a little carrier adhesion to photosensitive members.

A further object of the present invention is to provide a carrier for electrophotography and a two-component type developer for electrophotography, that may cause no charge-up even in an environment of low temperature and low humidity on account of its suitable surface resistance, can promise an always stable, high development efficiency, and also can maintain a high image density.

A still further object of the present invention is to provide a carrier for electrophotography and a two-component type developer for electrophotography, that can prevent charge injection from occurring from carrier into photosensitive member so as not to cause the phenomenon of carrier adhesion, and also can be free of image quality deterioration due to leak of charges, even when carrier cores with a low magnetic force are used for the purpose of making image quality higher.

A still further object of the present invention is to provide a process by which the carrier for electrophotography, coated with resin, can be produced simply and in a good efficiency.

A still further object of the present invention is to provide an image forming method making use of the above two-component type developer.

The present invention provides a carrier for use in electrophotography, comprising carrier particles, wherein;

the carrier particles each comprise a carrier core particle and a resin for coating the carrier core particle and having a resistivity of $10^{10}$ Ω·cm or above under conditions of a temperature of 23° C. and a humidity of 50% RH;

the carrier particles have an average particle diameter of not larger than 100 μm;

the carrier particles have a resistivity of $10^{10}$ Ω·cm or above; and the carrier particles comprise not less than 80% by number of resin-coated carrier particles whose carrier core particles are each coated with a resin in a coverage of not less than 90%.

The present invention also provides a process for producing a carrier, comprising the steps of;

forming a fluidized bed of carrier core particles in a tubular body by the aid of a gas flow ascending inside the tubular body; and spraying a coating resin solution in the direction perpendicular to or substantially perpendicular to the direction the carrier core particles ascend in the fluidized bed;

the coating resin solution being sprayed at a spray pressure of 1.5 kg/cm$^2$ or above; to produce a resin-coated carrier, wherein;

the carrier comprises carrier particles;

the carrier particles each comprise a carrier core particle and a resin for coating the carrier core particle and having a resistivity of $10^{10}$ Ω·cm or above under conditions of a temperature of 23° C. and a humidity of 50% RH;

the carrier particles have an average particle diameter of not larger than 100 μm;

the carrier particles have a resistivity of $10^{10}$ Ω·cm or above; and the carrier particles comprise not less than 80% by number of resin-coated carrier particles whose carrier core particles are each coated with a resin in a coverage of not less than 90%.

The present invention still also provides a two-component type developer for developing an electrostatic image, comprising toner particles and carrier particles, wherein;

the toner particles have a weight average particle diameter of not larger than 10 μm;

the carrier particles each comprise a carrier core particle and a resin for coating the carrier core particle and having a resistivity of $10^{10}$ Ω·cm or above under conditions of a temperature of 23° C. and a humidity of 50% RH;

the carrier particles have an average particle diameter of not larger than 100 μm;

the carrier particles have a resistivity of $10^{10}$ Ω·cm or above; and the carrier particles comprise not less than 80% by number of resin-coated carrier particles whose carrier core particles are each coated with a resin in a coverage of not less than 90%.

The present invention further provides an image forming method comprising;

forming an electrostatic image on an electrostatic image bearing member;

forming on a developer carrying member a magnetic brush formed of a two-component type developer; and developing the electrostatic image through the magnetic brush while applying a bias voltage to the developer carrying member, to form a toner image;

wherein;

the two-component type developer comprises toner particles and magnetic carrier particles;

the toner particles have a weight average particle diameter of not larger than 10 μm;

the carrier particles each comprise a carrier core particle and a resin for coating the carrier core particle and having a resistivity of $10^{10}$ Ω·cm or above under conditions of a temperature of 23° C. and a humidity of 50% RH;

the carrier particles have an average particle diameter of not larger than 100 μm;

the carrier particles have a resistivity of $10^{10}$ Ω·cm or above; and the carrier particles comprise not less than 80% by number of resin-coated carrier particles whose carrier core particles are each coated with a resin in a coverage of not less than 90%.

DESCRIPTION OF THE PREFERRED EMBODIMENTS

Figure 1:
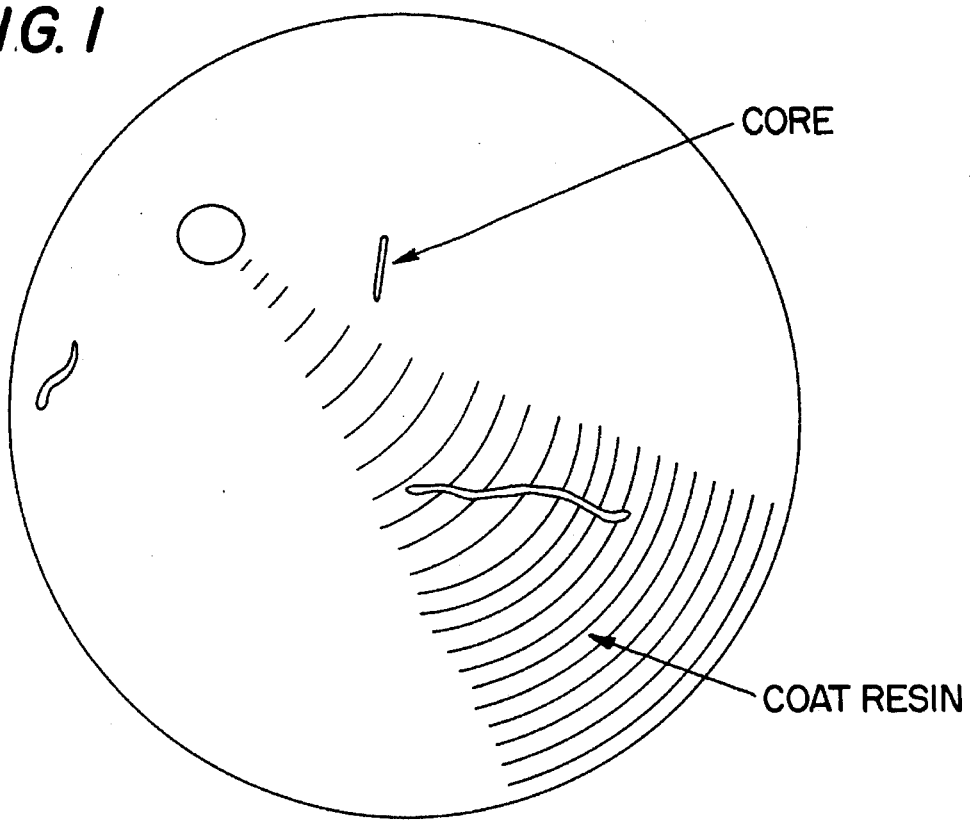
FIG. 1 illustrates a schematic appearance of the resin-coated carrier of the present invention, having a high resin coverage on a core particle.

The present invention aims at an improvement of carriers used in two-component type developers so that the objects of the present invention as stated above can be achieved.

As a result of detailed studies made by the present inventors from such a viewpoint, the carrier adhesion can be dramatically well prevented by using a coated carrier such that carrier particles whose carrier core particles are each coated with a resin in a coverage of not less than 90% are in a content not less than 80% by number of the whole carrier particles and have a resistivity of $10^{10}$ Ω·cm or above (preferably $10^{12}$ Ω·cm or above).

Use of the carrier described above not only makes it possible to prevent carrier adhesion but also can be very effective for image reproduction, in particular, for dot reproduction, fine-line reproduction and image uniformity at solid-image areas.

This is presumed to be due to the fact that the carrier adhesion is chiefly caused, as a predominant factor, by the injection of charges from a developer carrying member (e.g., a developing sleeve) into the carrier when a developing bias voltage is applied. The deterioration of dot reproduction and fine-line reproduction is presumed to be caused by the leak of charges on a photosensitive member (e.g., a photosensitive drum or a photosensitive belt) to the developing sleeve. Hence, it is presumed that dot-wise digital electrostatic images in the vicinity of leaks become non-uniform to cause a lowering of image quality.

This phenomenon tends to remarkably appear especially when the development process where a magnetic brush formed of a developer on a developing sleeve is brought into contact with a photosensitive member is used for the purpose of improving development efficiency. This phenomenon also tends to particularly appear in the development process where an alternating electric field is applied.

Such phenomena have been found to greatly depends on the coverage attained when the core particles of carrier particles are coated with resin. Resistivity of a powder is commonly calculated from electric current values obtained when the powder is filled in a given volume and current characteristics are measured under application of a given pressure. The volume resistivity of powder measured by such a method apparently increases when the coating resin applied onto carrier core particles is made to have a thickness larger than a given thickness.

However, in the development process where a magnetic brush formed of a developer on a developing sleeve is brought into contact with a photosensitive member, direct charge injection from the carrier into the photosensitive member takes place when the part of the surface of each carrier particle from which its core particle is partly bare comes into contact with the photosensitive member, so that the carrier adhesion tends to occur. In that case, the injected charges disorder the surrounding electrostatic images to cause a lowering of image quality. Hence, it is necessary to enhance the resin coverage on carrier core particles.

Figure 2:
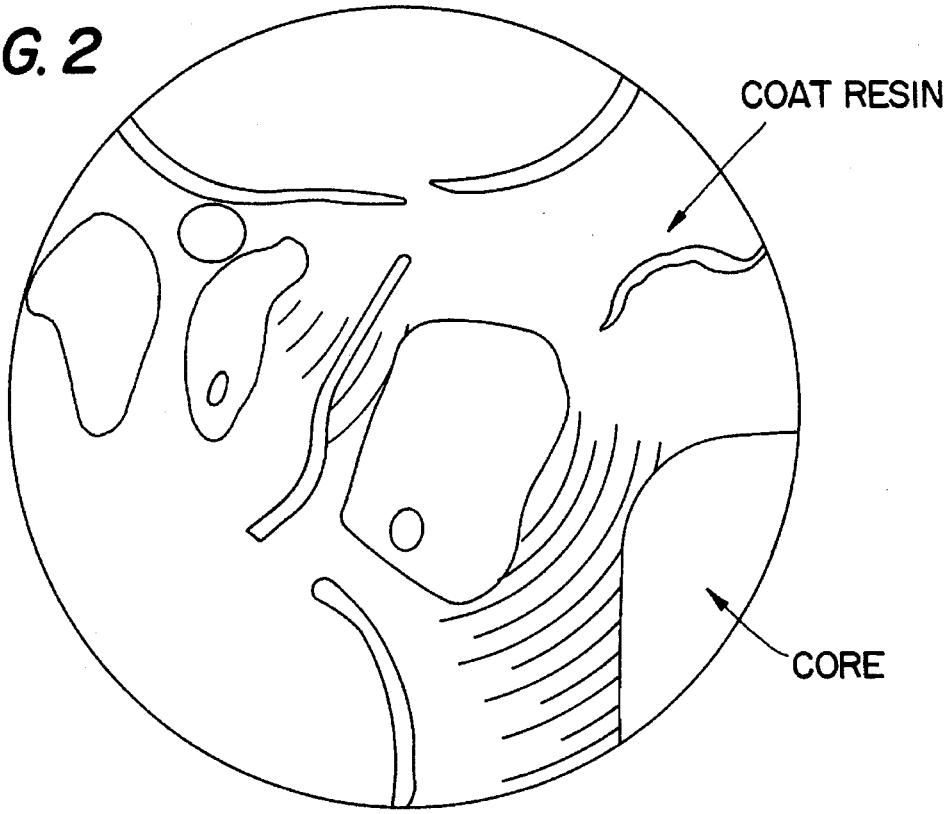
FIG. 2 illustrates a schematic appearance of the resin-coated carrier of a comparative example, having a low resin coverage on a core particle.

The present invention has solved such problems, and provides a two-component type developer with a high image quality and a high vividness. FIG. 1 shows a schematic view of such a carrier of the present invention. FIG. 2 shows a coated carrier having an insufficient coverage.

The carrier of the present invention can be produced by a process that may cause no decrease in coverage especially in the case of coated carriers, and also by a process that enables uniform surface coating of carrier core particles even when they have a small resin coating weight.

The present invention will be described below in greater detail by Giving preferred embodiments.

The objects of the present invention can be achieved by using carrier particles coated with resin to a higher extent. It is important for such a carrier to comprise resin-coated carrier particles whose carrier core particles are each coated with a resin in a coverage of not less than 90% are present in a content not less than 80% by number.

More preferably, the carrier particles each having a coverage of not less than 90% are in a content not less than 90% by number. It is most preferable to use a resin-coated carrier in which carrier particles each having a high coverage of not less than 95% are in a content not less than 60% by number.

If the carrier particles each having a coverage of not less than 90% are less than 80% by number, the magnetic brush of the developer can not be well made to have a high resistivity and insulation, so that the disorder of electrostatic images can not be prevented well and also the carrier adhesion can not be prevented well.

The carrier used in the present invention has a resistivity of $10^{10}$ Ω·cm or above, and preferably $10^{12}$ Ω·cm or above at an electric field intensity of $5\times10^4$ V/m. If it has a resistivity lower than that value, the carrier adhesion and a lowering of image quality may occur to make it impossible to satisfactorily achieve the high image quality and high vividness aimed in the present invention. The measurement of resistivity of the carrier particles, made in the present invention will be described later.

From the viewpoint of a higher image quality, it is important for the carrier of the present invention to have a particle diameter as small as possible. From such a viewpoint, the carrier of the present invention may preferably be a carrier with a small particle diameter. It is preferable from the viewpoint of a higher image quality to use carrier particles having a number average particle diameter not larger than 100 μm, and more preferably those having a number average particle diameter in the range of from 10 to 60 μm. The measurement of carrier particle diameter, made in the present invention will be described later.

The carrier core particles are grouped into magnetic core particles substantially comprised of only a magnetic material such as magnetic ferrite, and magnetic material disperse type resin core particles comprised of a large number of magnetic fine particles dispersed in a resin.

In the case of the magnetic core particles, the magnetic material that forms carrier core particles may include magnetic metals such as iron, nickel and cobalt and alloys thereof, or alloys thereof containing rare earth elements; and iron oxides as exemplified by soft ferrites such as hematite, magnetite, manganese-zinc ferrite, nickel-zinc ferrite, manganese-magnesium ferrite and lithium ferrite, copper-zinc ferrite, and mixtures of any of these.

It is also possible to use other iron alloys as exemplified by iron-silicon alloys, iron-aluminum alloys, iron-silicon-aluminum alloys, and permalloys. In the present invention, it is preferable to use magnetic ferrite core particles whose ferrite particles are magnetic particles containing at least one element selected from Groups IA, IIA, IIIA, IVA, VA, VIA, IB, IIB, IVB, VB, VIB, VIIB and VIII of the periodic table and also containing other element in an amount of less than 1% by weight.

The magnetic material core particles used in the present invention can be produced by a process such as burning or atomizing, and magnetic material core particles having the prescribed magnetic properties can be produced optionally by pulverizing the magnetic material in a sharp particle size distribution or by controlling burning temperature, rate of temperature rise and heating time.

With regard to the resistivity of the magnetic material core particles used in the present invention, those satisfying the desired magnetic properties may be used. Ferrite particles or magnetite particles having a resistivity of from $10^5$ Ω·cm to $10^{10}$ Ω·cm may preferably be used, and more preferably those of from $10^5$ Ω·cm to $10^9$ Ω·cm.

In the case of the magnetic material disperse type resin core particles, the magnetic material constituting magnetic fine particles dispersed in resin may include ferromagnetic metals such as iron, cobalt and nickel; iron compounds such as ferrite, magnetite and hematite; and alloys or compounds of ferromagnetic metals such as iron, cobalt and nickel.

Binder resin that constitutes the magnetic material disperse type resin core particles may include resins obtained by polymerizing vinyl monomers. The vinyl monomers can be exemplified by styrene; styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene and p-nitrostyrene; unsaturated monoolefins such as ethylene, propylene, butylene and isobutylene; unsaturated diolefins such as butadiene and isoprene; vinyl halides such as vinyl chloride, vinylidene chloride, vinyl bromide and vinyl fluoride; vinyl esters such as vinyl acetate, vinyl propionate and vinyl benzoate; methacrylic acid, and α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid, and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid, and maleic half esters; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarhazole, N-vinylindole and N-vinylpyrrolidone; vinylnaphthalenes; acrylic or methacrylic acid derivatives such as acrylonitrile, methacrylonitrile and acrylamide; and acroleins. Polymers obtained using one or more kinds of any of these can be used.

Besides the resins obtained by polymerizing vinyl monomers, it is also possible to use non-vinyl condensation type resins such as polyester resin, epoxy resin, phenol resin, urea resin, polyurethane resin, polyimide resin, cellulose resin and polyether resin, or mixtures of any of these with the vinyl resins described above.

Deterioration of two-component type developers is considered to be chiefly caused when the shear acting between toner and carrier or between carrier particles one another damages the carrier during use of the developer over a long period of time.

Use of a resin carrier having a small specific gravity, comprising the magnetic material disperse type resin core particles coated with resin makes small the shear acting between toner and carrier or between carrier particles one another, so that the damage to the carrier can be decreased. As to the carrier itself, the resin carrier has a high adhesion between cores and coated resin layers and can retain uniform coat layers, so that the image deterioration due to separation of coat layers of the carrier may hardly occur.

The coating uniformity attributable to the resin is presumed to improve the resistivity and charging stability of the magnetic material disperse type resin carrier particles to prevent the phenomenon of carrier adhesion. At the same time, it is also effective for the durability of the carrier, such as anti-spent properties, impact resistance and breakdown resistance to applied voltage.

Use of such a resin carrier, which is lightweight and also has a smaller magnetic force than conventional ferrite, decreases the deterioration of developers and achieves a higher image quality of the images obtained. At the same time, it settles the phenomenon of carrier adhesion concurrently coming into question, from the two directions of the state of carrier coating and the control of resistivity, also bringing about an improvement in the durability of the carrier.

The carrier of the present invention can be obtained by coating the resin on, in particular, the carrier cores described above. The coating resin used in the present invention may preferably be in a coating weight ranging from 0.5% by weight to 15% by weight, and more preferably from 0.6% by weight to 10% by weight.

In a coating weight less than 0.5% by weight, it becomes difficult to well coat the carrier cores, consequently tending to produce carrier particles with a low resistivity. In a coating weight more than 15% by weight, because of an excessive resin coating weight, the resistivity can be controlled within the desired range but the fluidity may become poor and the running image characteristics tend to deteriorate. In the present invention, the resin coating weight is determined using a thermobalance (TGA: TGA-7 Type, manufactured by Perkin Elmer Co.), and determined from the rate of weight loss. The determination of the coverage of the coating resin on the carrier cores used in the present invention will be described later.

The coating resin used in the present invention may preferably be an insulating resin comprising the resin having a resistivity of $10^{10}$ Ω·cm or above under conditions of temperature 23° C. and humidity 50% RH.

The resin for coating the carrier core particles may preferably be a medium-resistance resin having a resistivity of from not lower than $10^{10}$ Ω·cm to lower than $10^{13}$ Ω·cm under conditions of temperature 23° C. and humidity 50% RH, which may be either thermoplastic resin or thermosetting resin. The thermoplastic resin may specifically include electron conductive polymers such as polyamide, polyamine, polyalkylene oxides, polyester, polyalkylene sulfides, phosphazene, and derivatives thereof; polypyrrole, polythiophene, polyaniline, polyacetylene, polyparaphenylene, polyparaphenylenevinylene and polythiophenevinylene, any of which may be dispersed in a suitable binder resin to obtain the coating resin.

As the binder resin, the coating resin described later, having a resistivity of $10^{13}$ Ω·cm or above may be used.

The thermosetting medium-resistance resin may include urethane resin, epoxy resin, vinyl resin, acrylic resin, melamine resin and silicone resin made of compounds having the above conductive structural unit.

The resin describe above may be used alone, or may be used in combination of any of them. Resins obtained by mixing the thermoplastic resin with a hardener followed by hardening may also be used.

A medium-resistance resin composition may be formed using a composition prepared by dispersing conductive fine powder in the binder resin, and the resulting composition may also be used as the coating resin.

The conductive fine powder may include powders, scaly powders and short fibers of metals such as aluminum, copper, nickel and silver; powders of alloys or mixtures of such metals; conductive metal oxides such as antimony oxide, indium oxide and tin oxide; polymeric conductive agents such as polymeric electrolytes; and carbon fiber, carbon black, graphite powder, or conductive powders whose particle surfaces are coated with any of these conductive materials.

As the insulating resin having a resistivity of $10^{13}$ Ω·cm or above, either thermoplastic resin or thermosetting resin may be used. Stated specifically, the thermoplastic resin may include styrene resins such as polystyrene; acrylic resins such as polymethyl methacrylate and a styrene-acrylic acid copolymer; a styrene-butadiene copolymer, an ethylene-vinyl acetate copolymer, vinyl chloride resin, vinyl acetate resin, polyvinylidene fluoride resin, fluorocarbon resin, perfluorocarbon resin, solvent-soluble perfluorocarbon resin, polyvinyl alcohol, polyvinyl acetal, polyvinyl pyrrolidone, pertroleum resin; cellulose, and cellulose derivatives such as cellulose acetate, cellulose nitrate, methyl cellulose, hydroxymethyl cellulose, hydroxyethyl cellulose and hydroxypropyl cellulose; novolak resin, low-molecular weight polyethylene, saturated alkylpolyesters; aromatic polyester resins such as polyethylene terephthalate, polybutylene terephthalate and polyallylate; polyamide resin, polyacetal resin, polycarbonate resin, polyether sulfone resin, polysulfone resin, polyphenylene sulfide resin, and polyether ketone resin.

The thermosetting resin may include, for example, phenol resin, modified phenol resin, maleic resin, alkyd resin, epoxy resin, acrylic resin; unsaturated polyester resins obtained by polycondensation of maleic anhydride, terephthalic acid and a polyhydric alcohol; urea resin, melamine resin, urea-melamine resin, xylene resin, toluene resin, guanamine resin, melamine-guanamine resin, acetoguanamine resin, Glyptal resin, furan resin, silicone resin, polyimide, polyamidoimide resin, polyetherimide resin, and polyurethane resin.

The above resins may be used alone, or may be used in combination of some of these. Resins obtained by mixing the thermoplastic resin with a hardener followed by hardening may also be used.

As methods for coating the carrier core particles with the resin, it is preferable to use a treating method by which the coating resin can be rapidly applied without mutual adhesion of core particles when the core particles are coated with the resin, and a treating method in which the coating and drying are simultaneously carried on in the manner that the selection of solvents for dissolving the coating resin and the conditions such as treatment temperature and time can be well controlled and also the core particles are always fluidized. The resin coating weight depends on the true specific gravity of the core particles. An optimum value thereof may preferably satisfy the following relationship.

$$2.5/X \leqq \text{resin coating weight} \leqq 75/X \quad \text{(\% by weight);}$$

and more preferably;

$$3/X \leqq \text{resin coating weight} \leqq 50/X \quad \text{(\% by weight);}$$

wherein X represents a true specific gravity of carrier core particles.

If the resin coating weight is less than 2.5/X (% by weight), it is difficult to uniformly coat the core particle surfaces. Even if it is possible to do so, the coat layers tend to have a low strength.

If the resin coating weight is more than 75/X (% by weight), it is difficult to uniformly coat the core particle surfaces, and it tends to become difficult to control the resistivity characteristic of the present invention so as to be at the optimum value. Moreover, in some instances, resin-coated particles not uniformly coated may be produced in a solely released state and may adhere to the photosensitive member to cause image deterioration.

The coated carrier of the present invention can be preferably produced by a process in which, using a fluidized-bed coating apparatus, a coating resin solution is sprayed while the carrier core particles are fluidized, to form coating films on the core particle surfaces, and also by spray drying.

Stated specifically, the carrier for electrophotography of the present invention can be produced by a process comprising the following three steps, i.e., the steps of;

(1) forming a fluidized bed of carrier core particles in a cylindrical tube by the aid of a gas flow ascending inside the tube;

(2) feeding a coating resin solution in the direction perpendicular to the direction the fluidized bed moves; and (3) spraying the coating resin solution to the core particles at a spray pressure of 1.5 kg/cm$^2$ or above. Such a process makes it possible to well efficiently produce the resin-coated carrier of the present invention, having the superior properties stated above.

When the fluidized-bed coating apparatus is used, the state of the fluidized bed formed and the form of spray of the resin solution in which the coating resin has been dissolved are especially important. The state of the fluidized bed formed as described above can be obtained by a method in which a rotary bottom disk plate and an agitating blade are provided in the zone of the fluidized bed and the coating is carried out while forming circulating flows so that the coating films can be formed on the carrier core particle surfaces without causing agglomeration of carrier particles and also in a good efficiency.

Figure 5:
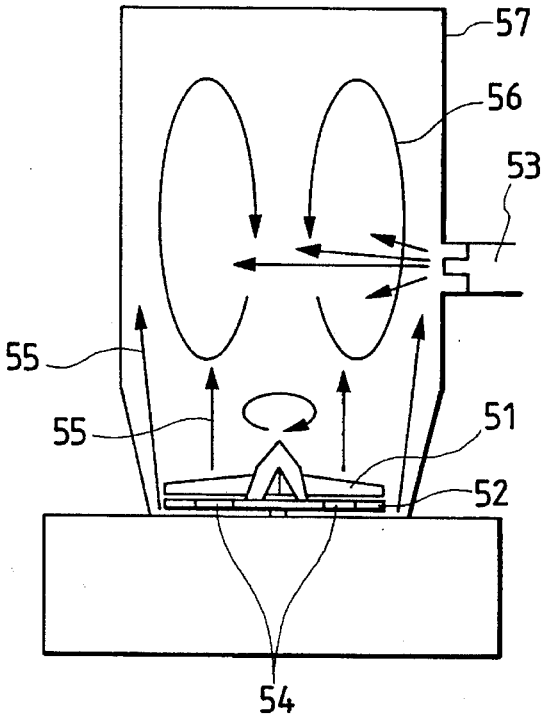
FIG. 5 schematically illustrates an example of a coating apparatus for coating carrier core particles with resin.

FIG. 5 schematically illustrates an example of a coating apparatus for coating the carrier core particles with the resin. In a tubular body 57, the carrier core particles form a fluidized bed 56 by the aid of air 55 blown off upward from the bottom of the apparatus. At the lower part in the apparatus, an agitating blade 51 and a rotary disk 52 are provided, and are clockwise rotated as viewed in FIG. 5. The rotary disk 52 has a mesh 54, and the air is also blown off upward through the mesh. The tubular body 57 is provided with a spray nozzle in its side wall, and the coating resin solution is sprayed from the spray nozzle 53 in the direction perpendicular to or substantially perpendicular (within a deviation of not larger than ±45° from the perpendicular direction) to the direction the carrier core particles ascend and descend, so that the carrier core particle surfaces are coated with the resin. In view of uniform coating, the coating resin solution may preferably be sprayed under conditions such that the spray pressure is 1.5 kg/cm$^2$ or above.

In the coating apparatus shown in FIG. 5, the rotation of the agitating blade 51 and rotary disk 52 makes it possible to prevent agglomeration of the carrier core particles suspending and the carrier core particles being gradually coated, to keep the carrier core particles and the coated carrier core particles in the state of primary particles throughout the coating process, and to improve the efficiency of the carrier core particle coating.

As other production process, a coating process in which solvent is gradually evaporated while applying a shear force is available. Such a process may specifically include a process in which solvent is evaporated at a temperature higher than the glass transition point of a coating resin and thereafter carrier particles having adhered one another are disintegrated, a process in which a coating resin capable of being applied using solvents that may cause no mutual dissolution is coated in multiple layers, and a process in which coatings are hardened and disintegrated while applying a shear force. However, the coating process described above first is preferable since uniform coat layers can be stably formed on the carrier core particle surfaces.

The carrier of the present invention may preferably be a magnetic carrier of a low magnetic force, having a magnetization intensity at 1,000 oersteds in the range of from 30 to 250 emu/cm$^3$, more preferably from 40 to 250 emu/cm$^3$, and still more preferably from 40 to 100 emu/cm$^3$.

If the magnetization intensity is smaller than 30 emu/cm$^3$, it becomes hard to keep the magnetic carrier held by the magnetic force even when the magnetic characteristics of the developing sleeve is improved, and also the transport performance of the magnetic carrier tends to deteriorate.

If the magnetization intensity is greater than 250 emu/cm$^3$, the density of the magnetic brush for development, formed on the developing sleeve, may decrease and also the magnetic brush may become rigid, to cause wispy uneveness on copy images or cause image deterioration such as coarse half-tone images or uneven solid images due to deterioration of developers during running. In the present invention, the magnetic properties are measured using a vibrating magnetic field type magnetic properties automatic recorder BHV-30, manufactured by Riken Denshi K.K. Examples of measurement conditions will be described later.

On account of the carrier particle diameter and magnetizing force described above, toner images can be made to have a higher image quality. From parameters of the carrier particle diameter and magnetizing force described above, an image quality improvement parameter KP of carrier can be defined as shown by the following expression.

$$KP=I\times D$$

wherein I is a magnetizing force in a unit of emu/cm$^3$ of the magnetic material used in the carrier, and D is carrier particle diameter in a unit of cm.

The carrier image quality improvement parameter represented by the above expression indicates that, when the carrier image quality improvement parameter KP is smaller than a given value, it is hard to prevent carrier adhesion even if the carrier core particles can be coated in a higher coverage. When the carrier image quality improvement parameter KP is larger beyond a given range, it is hard to make image quality higher.

Thus, in the present invention, the above carrier image quality improvement parameter KP may preferably be in the range of:

$$0.08\ \text{emu/cm}^2<KP<1.0\ \text{emu/cm}^2$$

in order to well achieve the objects of the present invention, and most preferably the parameter KP may be in the range of:

$$0.1\ \text{emu/cm}^2<KP<0.8\ \text{emu/cm}^2.$$

The carrier of the present invention may preferably have a sphericity of not more than 2. If the sphericity is more than 2, the fluidity of the two-component type developer may become poor and the form of the magnetic brush may become bad to make it hard to obtain high-quality images.

The sphericity of carrier particles can be measured by sampling carrier particles at random using a field emission scanning electron microscope S-800, manufactured by Hitachi Ltd., and determining the coefficient of form calculated from the following expression.

Sphericity SF1=(MX LNG)$^2$/AREA×π/4 wherein MX LNG represents a maximum diameter of a carrier particle, and AREA represents a projected area of the carrier particle.

Here, the closer to 1 the SF1 is, the closer to a sphere the carrier particle is.

In the case when the carrier cores are the magnetic material disperse type resin core particles, the carrier may more preferably have a bulk density of 2.0 g/cm$^3$ or below. If it is higher than 2.0 g/cm$^3$, as the developing sleeve is rotated, the centrifugal force applied to individual carrier particles becomes larger than the force acting to magnetically hold carrier particles on the sleeve, to tend to cause carrier scatter, and also the shear in the developer becomes larger to tend to cause coat separation. The bulk density of the carrier is measured according to what is prescribed in JIS Z 2504.

The toner usable in the present invention may preferably have a weight average particle diameter of not larger than 10 μm, and preferably in the range of from 3 to 8 μm. The weight average particle diameter of toners can be measured by various methods. In the present invention, for example, a method in which a Coulter counter is used may be employed.

The Coulter counter usable in the present invention may specifically include Coulter Counter Model II (manufactured by Coulter Electronics, Inc.). Measurements obtained are analyzed to know, e.g., characteristics such as volume distribution and number distribution of particles. An electrolytic solution used in this measurement may be an aqueous 1% sodium chloride solution prepared using first-grade sodium chloride. A specific example of the measurement will be described later.

Binder resin of the toner used in the present invention may include, for example, polystyrene; styrene resins obtained from styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ketone copolymer, a styrene-butadiene copolymer, a styrene-isoprene copolymer and a styrene-acrylonitrile-indene copolymer; polyvinyl chloride, phenol resin, modified phenol resin, maleic acid resin, acrylic resin, methacrylic resin, polyvinyl acetate, silicone resin; polyester resins having as a structural unit a monomer selected from aliphatic polyhydric alcohols, aliphatic dicarboxylic acids, aromatic dicarboxylic acids, aromatic dialcohols and diphenols, polyurethane resin, polyamide resin, polyvinyl butyral, terpene resin, cumarone indene resin, and petroleum resin. It may also include cross-linked styrene resins and cross-linked polyester resins.

Vinyl monomers polymerizable with styrene, used in styrene-acrylic copolymers, may include acrylic acid, and acrylic esters having an ethylenic double bond and derivatives thereof as exemplified by methyl acrylate, ethyl acrylate, butyl acrylate, dodecyl acrylate, octyl acrylate, 2-ethylhexyl acrylate, phenyl acrylate, methyl methacrylate, ethyl methacrylate, butyl methacrylate, octyl methacrylate, acrylonitrile, methecrylonitrile end acrylamide; maleic acid, and half esters of maleic acid as exemplified by butyl maleate, and diesters thereof; vinyl esters such as vinyl acetate, vinyl chloride, vinyl methyl ether, vinyl ethyl ether, vinyl propyl ether and vinyl butyl ether; and vinyl ketones such as methyl vinyl ketone, ethyl vinyl ketone and hexyl vinyl ketone.

In the case when the binder resins are cross-linked vinyl resins, the cross-linking agent may include compounds mainly having at least two unsaturated bonds, including, for example, aromatic divinyl compounds such as divinyl benzene and divinyl naphthalene; carboxylic acid esters having two unsaturated bonds such as ethylene glycol diacrylate and ethylene glycol dimethacrylate; divinyl compounds such as divinyl aniline, divinyl ether, divinyl sulfide and divinyl sulfone; and compounds having at least three unsaturated bonds; any of which may be used alone or in the form of a mixture. The cross-linking agent may be used in an amount of from 0.01% to 10% by weight, and preferably from 0.05% to 5% by weight, on the basis of the monomer units constituting the binder resin.

In use of a pressure fixing system, binder resins for pressure-fixing toner are used, which may include, for example, polyethylene, polypropylene, polymethylene, polyurethane elastomers, an ethylene-ethyl acrylate copolymer, an ethylene-vinyl acetate copolymer, ionomer resin, a styrene-butadiene copolymer, a styrene-isoprene copolymer, linear saturated polyesters, paraffin and other waxes.

In the toner used in the present invention, a charge control agent may be used by compounding it in the toner. The addition of the charge control agent enables control of optimum triboelectric charges in conformity with developing systems. Positive charge control agents may include Nigrosine and fatty acid metal salts of Nigrosine; quaternary ammonium salts such as tributylbenzylammonium 1-hydroxy-4 -naphthosulfonate and tetrabutylammonium teterafluoroborate; diorganotin oxides such as dibutyltin oxide, dioctyltin oxide and dicyclohexyltin oxide; organic tin borates such as dibutyltin borate, dioctyltin borate and dicyclohexyltin borate; any of which may be used alone or in combination of two or more kinds. Of these charge control agents, Nigrosine type charge control agents or charge control agents such as quaternary ammonium salts are particularly preferred.

As negative charge control agents, organic metal complexes and chelate compounds are preferred, which may include azo type metal complex, aluminumacetylacetonato, iron (II) acetylacetonato, and chromium 3,5-di-tert-butylsalicylate. In particular, acetylacetone metal complexes (including monoalkyl derivatives and dialkyl derivatives), salicylic acid type metal complexes (including monoalkyl derivatives and dialkyl derivatives), or salts thereof are preferred. Salicylic acid type metal complexes are particularly preferred.

The above charge control agent may preferably be used in an amount of from 0.1 part to 20 parts by weight, and more preferably from 0.2 part to 10 parts by weight, based on 100 parts by weight of the binder resin. Especially when used in color image formation, it is preferable to use colorless or pale-colored charge control agents.

In the toner used in the present invention, it is preferable to mix or add fine powder such as fine silica powder, fine alumina powder, fine titanium oxide powder, fine polytetrafluoroethylene powder, fine polyvinylidene fluoride powder, fine polymethyl methacrylate powder, fine polystyrene powder or fine silicone powder. When the fine powder described above is mixed or add in the toner, the fine powder becomes present between toner particles and carrier particles or between toner particles one another, so that the fluidity of the developer is improved and also the lifetime of the developer is improved. As the fine powder described above, those having a specific surface area, as measured by the BET method using nitrogen absorption, of not less than 30 $m^2/g$, and preferably in the range of from 50 to 400 $m^2/g$, can give good results. Such fine powder may preferably be added in an amount of from 0.1 to 20% by weight based on the weight of the toner.

As colorants usable in the toner used in the present invention, conventionally known dyes and pigments may be used. For example, carbon black, Phthalocyanine Blue, Peacock Blue, Permanent Red, Lake Red, Rhodemine Lake, Henza Yellow, Permanent Yellow and Benzidine Yellow may be used. When used, the colorant may be added in an amount of from 0.1 part to 20 parts by weight, and preferably from 0.5 part to 20 parts by weight, based on 100 parts by weight of the binder resin. Taking account of preferable transmission of toner images on OHP films, it may also preferably be used in an amount of not more than 12 parts by weight, in particular, most preferably from 0.5 part to 9 parts by weight.

For the purpose of improving releasability at the time of heat-roll fixing, a wax component such as polyethylene, polypropylene, microcrystalline wax, carnauba wax, sazole wax or paraffin wax may be added to the toner of the present invention.

The toner having such composition can be produced by thoroughly mixing a vinyl type thermoplastic resin or non-vinyl type thermoplastic resin, a colorant, a charge control agent and other additives by means of a mixing machine, thereafter melt-kneading the mixture using a kneading machine such as a heat roll, a kneader or an extruder to well mix resins and make them melt together, and dispersing a pigment or dye in the molten product. The melt-kneaded product obtained is cooled, followed by pulverization and strict classification to obtain toner particles. The toner particles may be used as a toner as they are. A suitable kind and amount of fine powder may be optionally further added thereto.

Such external addition of fine powder can be carried out using a mixing machine such as a Henschel mixer. The toner thus obtained is blended with the carrier particles of the present invention, and thus can be formed into the two-component type developer. When this two-component type developer is formed, the toner in the developer may preferably be in a proportion, depending on development processes, of from 1% to 20% by weight, and more preferably from 1% to 10% by weight. The toner of such a two-component type developer may preferably have a quantity of triboelectricity in the range of from 5 to 100 μC/g, and most preferably from 5 to 60 μC/g. Conditions for measuring the quantity of triboelectricity, used in the present invention will be described later.

The respective physical properties of the carrier and toner are measured in the manner as described below.

Measurement of resistivity

Figure 3:
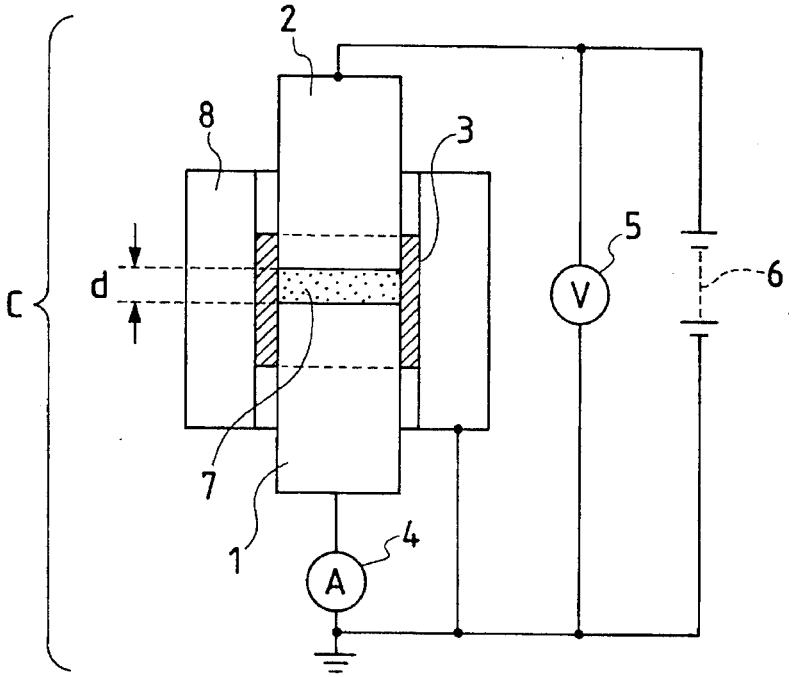
FIG. 3 schematically illustrates a measuring device for measuring the resistivity of a powder.

FIG. 3 shows a device for measuring the resistivity of powder. Used is a method in which a carrier is packed in a cell C and a lower electrode 1 and an upper electrode 2 are so provided as to come into contact with the packed carrier, where a voltage is applied across the electrodes and the electric currents flowing at that time are measured to determine resistivity. In this measuring method, a change may occur in packing because the carrier is a powder, which may be accompanied with a change in resistivity, and thus care must be taken. The resistivity in the present invention is measured under conditions of a contact area S between the packed carrier and the electrodes of about 2.3 $cm^2$, a thickness d of about 1 mm, a load of the upper electrode 2 of 180 g and an applied voltage of 100 V. In FIG. 3, reference numeral 3 denotes an insulating material; 4, an ammeter; 5, a voltmeter; 6, a voltage stabilizer; 7, carrier particles or carrier core particles; and 8, a guide ring.

Measurement of average particle diameter of carrier

Particle size of carrier particles is measured by means of an optical microscope, where 300 or more particles are sampled at random and their horizontal direction Feret's diameters are measured as carrier particle diameters using an image processing analyzer LUZEX 3, manufactured by Nireko K.K.

Measurement of coverage of carrier core particles with coating resin

Resin coverage on coated carrier particles is measured using an image processing analyzer LUZEX 3, manufactured by Nireko K.K., on a photographic image magnified 2,000 times by a scanning electron microscope. For one carrier particle, the carrier is observed using a microscope from the vertically upper part, where, in respect of the carrier particle front semisphere, the area of the part covered with resin and the carrier cope area are two-dimensionally digitized to determine each area by image analysis, and the area ratio of the resin-coated part to the carrier particle area is calculated as resin coverage. In the present invention, 300 or more carrier particles are sampled at random to repeat this operation, and the measurements are averaged.

Measurement of weight average particle diameter of toner

A Coulter counter Model TA-II (manufactured by Coulter Electronics, Inc.) is used as a measuring device. An interface (manufactured by Nikkaki K.K.) that outputs number distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Number-based particle size distribution of particles of from 2 to 40 μm is measured by means of the above Coulter counter Model TA-II, using an aperture of 100 μm as its aperture. Then the weight average particle diameter (D4) is calculated.

Measurement of magnetic characteristics of carrier

To measure a value of magnetic characteristics of carrier particles, s magnetic field of plus-minus 1 kOe is formed and, from a hysteresis curve obtained there, magnetization at a magnetic field of 1,000 gauss is determined. A sample is prepared in the manner that carrier particles are well densly packed in a cylindrical plastic container. The carrier particles may preferably be densly packed so that the particles in the container do not move even when the external magnetic field varies. In this state, magnetization moment is measured, on the basis of which the magnetization intensity per unit volume is determined.

Measurement of resistivity of resin used to coat carrier core particles

To measure the resistivity of resin, a 20% solution of resin for measurement is prepared and thereafter a 5 μm thick coating is formed on 0.2 mm thick aluminum sheet by wire bar coating. The coating formed is dried, and then gold is deposited on the surface to form the anode, where currents are measured under conditions of an applied voltage of 5 V to determine the resistivity.

Measurement of quantity of triboelectricity of toner or carrier

Toner and carrier are blended in a toner concentration of 5% by weight, followed by mixing for 60 seconds using a tumbling mixer to obtain a developer. In the device shown in FIG. 4, this developer is put in a container 12 made of a metal at the bottom of which is provided a conducting screen 13 of 500 meshes, and air is sucked through a suction opening 17 by means of a suction pump, where the quantity of triboelectricity is determined from the difference in weight before and after suction and the potential accumulated in a capacitor 18 connected to the container 12. Here, the suction is carried out at a vacuum of 250 mmHg. By this method, the quantity of triboelectricity of toner or carrier is calculated using the following expression.

$$Q(\mu C/g)=(C\times V)\times(W1-W2)^{-1}$$

wherein W1 is the weight before suction, W2 is the weight after suction, C is capacitance of the capacitor, and V is potential accumulated in the capacitor.

Figure 4:
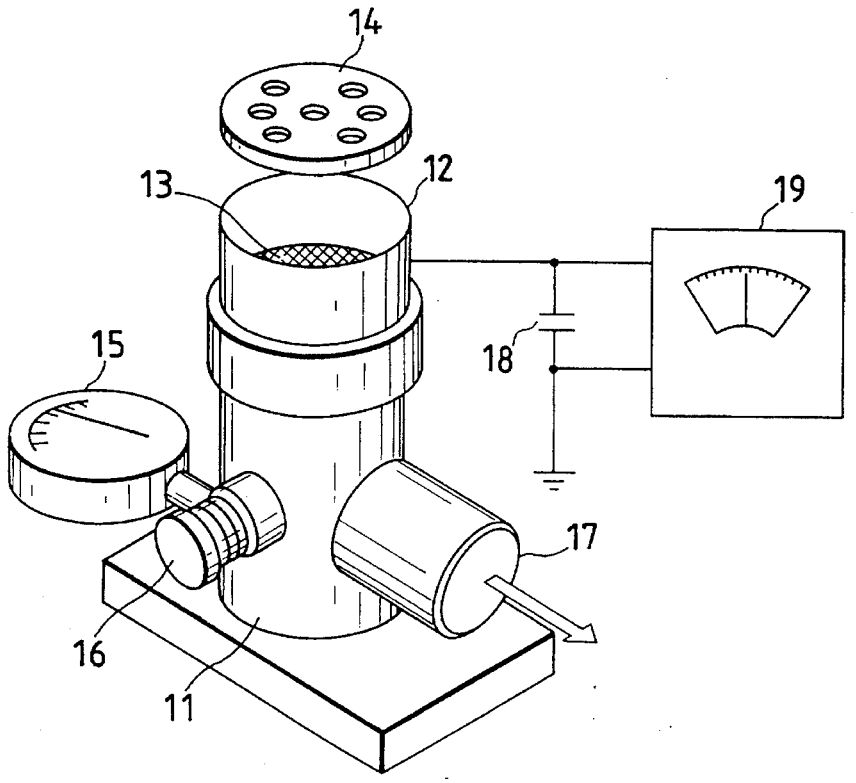
FIG. 4 schematically illustrates a device for measuring the quantity of triboelectricity of toners.

In FIG. 4, reference numeral 14 denotes a cover plate; 15, a vacuum indicator; 16, an airflow control valve; and 19, a potentiometer.

Figure 6:
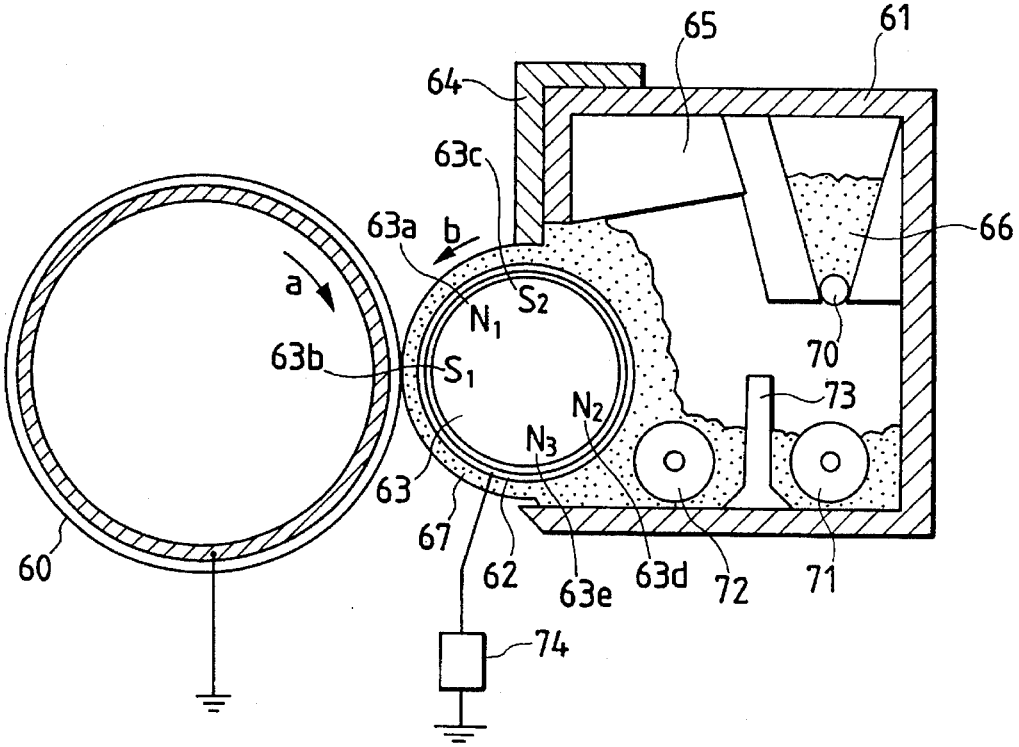
FIG. 6 schematically illustrates an example of an image forming apparatus for carrying out the image forming method of the present invention.

The image forming method of the present invention will be described below with reference to a developing apparatus shown in FIG. 6.

An electrostatic image bearing member 60 is an insulating drum for electrostatic recording or a photosensitive drum or photosensitive belt having a layer comprising a photoconductive insulating material such as α-Se, CdS, $ZnO_2$, OPC or α-Si. The electrostatic image bearing member 60 is rotated in the direction of an arrow a by means of a driving device (not shown). Reference numeral 62 denotes a developing sleeve serving as a developer carrying member coming into proximity to or contact with the electrostatic image bearing member 60, and is comprised of a non-magnetic material such as aluminum or SUS 316 stainless steel. The developing sleeve 62 is laterally provided in a rotatably supported state on a shaft in such a manner that it is thrust into a developing container 61 by substantially the right half of its periphery, from an oblong opening formed in the longitudinal direction of the container 61 in the wall at its left lower side, and is exposed to the outside of the container by substantially the left half of its periphery, and is rotated in the direction of an arrow b.

Reference numeral 63 denotes a stationary permanent magnet serving as a means for generating stationary magnetic fields, provided inside the developing sleeve (developer carrying member) 62 and held in alignment at the position and posture as shown in the drawing, and is stationarily held as it is, at the position and posture as shown in the drawing, even when the developing sleeve 62 is rotatingly driven. This magnet 63 has five magnetic poles of north (N) magnetic poles 63*a*, 63*e* and 63*d* and south (S) magnetic poles 63*b* and 63*c*. The magnet 63 may be comprised of an electromagnet in place of the permanent magnet.

Reference numeral 64 denotes a non-magnetic blade serving as a developer control member, provided on the upper edge of the opening of a developer feeding device at which the developing sleeve 62 is disposed, in such a manner that its base is fixed on the side wall of the container. The blade is made of, for example, SUS316 stainless steel so worked as to be bent in the L-form in its lateral cross section.

Reference numeral 65 denotes a magnetic carrier return member the front surface of which is brought into contact with the inner surface of the lower side of the non-magnetic blade (developer control member) 64 and the forward bottom surface of which is made to serve as a developer guide surface. The part composed of the non-magnetic blade 64, the magnetic carrier return member 65 and so forth is a control zone.

Reference numeral 67 denotes a developer layer having the carrier and toner of the present invention. Reference numeral 66 denotes a non-magnetic toner.

Reference numeral 60 denotes a toner supply roller which is operated in accordance with an output obtained from a toner density sensor (not shown). As the sensor, it is possible to utilize a developer volume detecting system, an antenna system utilizing a piezoelectric device, an inductance variation detecting device and an alternating current bias, or an optical density detecting system. The non-magnetic toner 66 is supplied by the rotating or stopping of the roller. A fresh developer supplied with the non-magnetic toner 66 is blended and agitated while it is transported by means of a developer transporting screw 71. Hence, the toner supplied is triboelectrically charged in the course of this transportation. Reference numeral 73 denotes a partition plate, which is cut out at the both ends of its longitudinal direction, and at these cutouts the fresh developer transported by the screw 71 is delivered to a screw 72.

The S magnetic pole 63*d* serve as a transport pole. It enables a recovered developer to be collected into the container after development has been carried out, and also the developer in the container to be transported to the control zone.

In the vicinity of the magnetic pole 63*d*, the fresh developer transported by the second screw 62 provided in proximity to the developing sleeve 62 and the developer recovered after developing are intermingled.

The distance d between the lower end of the non-magnetic blade 64 and the surface of the developing sleeve 62 may be in the range of from 100 to 900 μm and preferably from 150 to 800 μm. If this distance is smaller than 100 μm, the carrier particles tend to cause clogging between them to give an uneven developer layer and also may make it impossible to apply the developer in the quantity necessary for carrying out good development, so that only developed images with low density and much uneveness can be obtained in some cases. If on the other hand this distance is larger than 900 μm, the amount of the developer applied to the developing sleeve 62 may increase to make it impossible to control the developer layer to have a given thickness, so that magnetic particles may adhered to the electrostatic image bearing member 60 in a large quantity and at the same time the circulation of developer and the development control attributable to the developer limit control member 65 may become weak to tend to make the triboelectricity of toner short to cause fog.

It is preferred that the developer layer on the developing sleeve 22 is made to have a thickness equal to or slightly larger than the distance of the gap at which the developing sleeve 62 and the electrostatic image bearing member 62 are opposed, and an alternating voltage is applied to the developing sleeve 62. This distance of the gap may preferably be in the range of from 50 to 800 μm, and more preferably from 100 to 700 μm.

Application of an alternating voltage or a developing bias obtained by overlapping an alternating voltage and a DC voltage facilitates the movement of the toner from the developing sleeve 62 to the electrostatic image bearing member 60, so that images with much better quality can be formed.

AC voltage as the above alternating voltage to be applied may preferably be from 1,000 to 10,000 Vpp, and preferably from 2,000 to 8,000 Vpp. In the instance where the DC voltage is overlapped, the DC voltage may preferably be applied so as not to be higher than 1,000 V.

The present invention will be described below in greater detail by giving Examples and Comparative Examples. The present invention is by no means limited to these Examples.

EXAMPLE 1

$Fe_2O_3$, CuO and ZnO were weighed in molar ratio of 55 mol %, 25 mol % and 20 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic ferrite carrier core particles. Resistivity of the magnetic carrier core particles obtained was measured to find that it was $2\times10^8$ Ω·cm.

The surfaces of the carrier core particles thus obtained were coated with styrene/methyl methacrylate/2-ethylhexyl methacrylate copolymer resin (copolymerization ratio: 40/50/10) so as to be in a coating weight of 2% by weight by means of the coating apparatus as shown in FIG. 5.

More specifically, a carrier coating solution of 10% by weight of the above copolymer resin was prepared using toluene as a solvent. This coating solution was applied to the above carrier core particles, using the coating apparatus shown in FIG. 5 provided with a rotary bottom disk plate and an agitating blade in the zone of a fluidized bed and carrying out the coating while forming circulating flows. The above resin coating solution was sprayed in the direction perpendicular to the movement of the core particles in the fluidized bed inside the apparatus, and also the resin coating solution was sprayed at a pressure of 4 kg/cm$^2$. The carrier particles thus obtained were dried in the fluidized bed at a temperature of 80° C. for 1 hour to remove the solvent, and then coated carrier particles were obtained. The coated carrier particles thus obtained had an average particle diameter of 41 μm.

The resin coverage of the resulting coated carrier particles was measured using an electron microscope to reveal that the carrier particles with a coverage of not less than 90% were in a content of 94% by number of the whole carrier particles, and carrier particles with a coverage of not less than 95% were in a content of 65% by number.

A diagrammatic view of the coated magnetic carrier particle obtained is shown in FIG. 1.

Resistivity of the coated carrier particles was measured to find that it was $5\times10^{14}$ Ω·cm. Coating weight of the resin covering the coated carrier particle surfaces was also measured using a thermobalance (TGA-7, manufactured by Perkin Elmer Co.) to find that it was 2.0% by weight. Magnetic characteristics of the coated magnetic carrier particles were measured to find that the magnetization intensity at 1,000 oersteds ($\sigma_{1,000}$) was 52 emu/cm$^3$ (packing density of sample: 3.50 g/cm$^3$).

Physical properties of the carriers used in Examples are shown in Table 1.

| | |
|---|---|
| Polyester resin obtained by condensation of propoxylated bisphenol with fumaric acid | 100 parts by weight |
| Copper phthalocyanine pigment | 5 parts by weight |
| Chromium complex salt of di-tert-butyl-salicylic acid | 4 parts by weight |

The above materials were thoroughly premixed, and the mixture was thereafter melt-kneaded. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified by means of an elbow-jet multi-division classifier to obtain a cyan toner with a negative chargeability, having a weight average particle diameter of 7.5 μm.

Next, 100 parts by weight of the above cyan toner and 0.7 part by weight of a fine silica powder having been made hydrophobic by treatment with hexamethyldisilazane and 0.3 part by weight of fine alumina powder were mixed using a Henschel mixer to prepare a cyan toner having an external additive on the toner particle surfaces.

The above carrier and toner were blended in a toner concentration of 5.5% by weight to obtain a two-component type developer. Using this developer, images were reproduced on a modified machine of a full-color laser copying machine CLC-500, manufactured by Canon Inc. In this image reproduction, the distance between the developer carrying member (developing sleeve) and developer control member (non-magnetic blade) of the developing assembly was set at 600 μm, the distance between the developing sleeve and the electrostatic image bearing member (OPC photosensitive drum) at 450 μm, the peripheral ratio of the developing sleeve to the OPC photosenstive drum at 1.3:1, the magnetic field of development poles of the developing sleeve at 1,000 gauss, and the developing conditions at alternating electric field 1,800 Vpp and frequency 2,000 Hz.

As a result, the developer was sufficiently fed onto the developing sleeve, solid images had a high density, no coarse dots caused by charge leak were seen, and both halftone areas and line images showed good reproduction. Also, neither carrier scatter nor carrier adhesion to image areas and non-image areas was seen.

The results in the present Example are shown in Table 2.

EXAMPLE 2

The magnetic ferrite carrier core particles as used in Example 1 were coated with styrene/2-hydroxyethyl acrylate/methyl methacrylate copolymer resin (copolymerization ratio: 40/10/50; hydroxyl value KOH mg/g: 35) so as to be in a coating weight of 2% by weight.

More specifically, a carrier coating solution of 10% by weight of the above styrene copolymer resin was prepared using toluene as a solvent. This coating solution was applied to the magnetic ferrite carrier core particles in the same manner as in Example 1 to obtain coated carrier particles. The coated carrier particles thus obtained had an average particle diameter of 40 μm.

In the coated carrier particles thus obtained, the carrier particles with a resin coverage of not less than 90% were in a content of 91% by number, and carrier particles with a coverage of not less than 95% were in a content of 65% by number. Resistivity of the coated carrier particles was $4\times10^{14}$ Ω·cm. Coating weight of the resin was 2.0% by weight. $\sigma_{1,000}$ of the coated carrier particles was 52 emu/cm$^3$ (packing density of sample: 3.51 g/cm$^3$).

The coated magnetic carrier thus obtained was tested in the same manner as in Example 1. As a result, the same good results as in Example 1 were obtained.

EXAMPLE 3

The magnetic ferrite carrier core particles as used in Example 1 were coated with a mixed resin of 60% by weight of styrene/benzyl methacrylate copolymer (copolymerization ratio: 55/45) and 40% by weight of vinylidene fluoride/tetrafluoroethylene copolymer (copolymerization ratio: 75/25).

More specifically, a carrier coating solution of 10% by weight of the above copolymer resin was prepared using toluene as a solvent. Using this coating solution, the coating was carried out in the same manner as in Example 1 to obtain coated carrier particles. The coated carrier particles thus obtained had an average particle diameter of 41 μm.

In the coated carrier particles thus obtained, the carrier particles with a resin coverage of not less than 90% were in a content of 91% by number, and carrier particles with a coverage of not less than 95% were in a content of 61% by number. Resistivity of the coated carrier particles was $8\times10^{14}$ Ω·cm. Coating weight of the resin was 2.0% by weight. $\sigma_{1,000}$ of the coated carrier particles was 52 emu/cm$^3$ (packing density of sample: 3.51 g/cm$^3$).

The coated magnetic carrier thus obtained was tested in the same manner as in Example 1. As a result, the same good results as in Example 1 were obtained.

EXAMPLE 4

To coat the magnetic ferrite carrier core particles as used in Example 1, a carrier coating solution of 5% by weight of the resin as used in Example 1 was prepared using toluene as a solvent. Using this coating solution, the coating was carried out in the same manner as in Example 1 to obtain coated carrier particles. The coated carrier particles thus obtained had an average particle diameter of 42 μm.

In the coated carrier particles thus obtained, the carrier particles with a resin coverage of not less than 90% were in a content of 97% by number, and carrier particles with a coverage of not less than 95% were in a content of 85% by number. Resistivity of the coated carrier particles was $2\times10^{15}$ Ω·cm. Coating weight of the resin was 4.9% by weight. $\sigma_{1,000}$ of the coated carrier particles was 50 emu/cm$^3$ (packing density of sample: 3.36 g/cm$^3$).

The coated magnetic carrier thus obtained was tested in the same manner as in Example 1. As a result, the same Good results as in Example 1 were obtained.

EXAMPLE 5

$Fe_2O_3$, CuO and ZnO were weighed in molar ratio of 53 mol %, 25 mol % and 22 mol %, respectively, which were then mixed using a ball mill.

The resulting mixture was calcined, followed by pulverization using the ball mill and then Granulation by means of a spray dryer. The resulting product was subjected to burning, further followed by classification to obtain magnetic ferrite carrier core particles with an average particle diameter of 64 μm. Resistivity of the magnetic carrier core particles obtained was measured to find that it was $2\times10^8$ Ω·cm.

The surfaces of the carrier core particles thus obtained were coated with the same resin as in Example 1 so as to be in a coating weight of 1.7% by weight to obtain coated carrier particles. The coated carrier particles thus obtained had an average particle diameter of 65 μm.

In the coated carrier particles thus obtained, the carrier particles with a resin coverage of not less than 90% were in a content of 96% by number, and carrier particles with a coverage of not less than 95% were in a content of 61% by number. Resistivity of the coated carrier particles was $9\times10^{14}$ Ω·cm. Coating weight of the resin was 1.7% by weight. $\sigma_{1,000}$ of the coated carrier particles was 54 emu/cm$^3$ (packing density of sample: 3.55 g/cm$^3$).

The coated magnetic carrier thus obtained was tested in the same manner as in Example 1. As a result, the same good results as in Example 1 were obtained.

EXAMPLE 6

$Fe_2O_3$, CuO and ZnO were weighed in molar ratio of 55 mol %, 25 mol % and 20 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic ferrite carrier core particles. Resistivity of the magnetic carrier core particles obtained was measured to find that it was $2\times10^8$ Ω·cm.

To coat the resulting magnetic ferrite carrier core particles, a carrier coating solution of 3% by weight of silicone resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the core particles in the fluidized bed inside the apparatus, and also the resin coating solution was sprayed at a pressure of 4 kg/cm$^2$. The carrier particles thus obtained were dried in the fluidized bed at a temperature of 120° C. for 1 hour to remove the solvent, and then coated carrier particles were obtained. The coated carrier particles thus obtained had an average particle diameter of 41 μm. The coated carrier thus obtained was tested in the same manner as in Example 1. As a result, the same good results as in Example 1 were obtained.

The resin coverage of the resulting coated carrier particles was measured using an electron microscope to reveal that the carrier particles with a coverage of not less than 90% were in a content of 91% by number of the whole carrier particles, and carrier particles with a coverage of not less than 95% were in a content of 68% by number. Resistivity of the carrier particles was measured to find that it was $7\times10^{14}$ Ω·cm. Coating weight of the resin covering the coated carrier particle surfaces was also measured using a thermobalance (TGA-7, manufactured by Perkin Elmer Co.) to find that it was 2.2% by weight. Magnetic characteristics of the coated carrier particles were measured to find that $\sigma_{1,000}$ was 52 emu/cm$^3$ (packing density of sample: 3.50 g/cm$^3$).

EXAMPLE 7

$Fe_2O_3$, CuO and ZnO were weighed in molar ratio of 55 mol %, 25 mol % and 20 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic ferrite carrier core particles. Resistivity of the magnetic ferrite carrier core particles obtained was measured to find that it was $2\times10^8$ Ω·cm.

To coat the resulting magnetic ferrite carrier core particles, a carrier coating solution of 3% by weight of melamine resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and also the resin coating solution was sprayed at a pressure of 4 kg/cm$^2$. The carrier particles thus obtained were dried in the fluidized bed at a temperature of 120° C. for 1 hour to remove the solvent, and then coated carrier particles were obtained. The coated carrier particles thus obtained had an average particle diameter of 41 μm. The coated carrier thus obtained was tested in the same manner as in Example 1. As a result, the same good results as in Example 1 were obtained.

The resin coverage of the resulting coated carrier particles was measured using an electron microscope to reveal that the carrier particles with a coverage of not less than 90% were in a content of 93% by number of the whole carrier particles, and carrier particles with a coverage of not less than 95% were in a content of 65% by number. Resistivity of the carrier particles was measured to find that it was $6\times10^{14}$ Ω·cm. Coating weight of the resin covering the coated carrier particle surfaces was also measured using a thermobalance (TGA-7, manufactured by Perkin Elmer Co.) to find that it was 2.1% by weight. Magnetic characteristics of the coated carrier particles were measured to find that $\sigma_{1,000}$ was 52 emu/cm$^3$ (packing density of sample: 3.50 g/cm$^3$).

EXAMPLE 8

$Fe_2O_3$, CuO and ZnO were weighed in molar ratio of 55 mol %, 25 mol % and 20 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic ferrite carrier core particles. Resistivity of the magnetic ferrite carrier core particles obtained was measured to find that it was $2\times10^8$ Ω·cm.

To coat the resulting magnetic ferrite carrier core particles, a carrier coating solution of 3% by weight of phenol resol resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and also the resin coating solution was sprayed at a pressure of 4 kg/cm$^2$. The carrier particles thus obtained were dried in the fluidized bed at a temperature of 120° C. for 1 hour to remove the solvent, and then coated carrier particles were obtained. The coated carrier particles thus obtained had an average particle diameter of 41 μm. The coated carrier thus obtained was tested in the same manner as in Example 1. As a result, the same Good results as in Example 1 were obtained.

The resin coverage of the resulting coated carrier particles was measured using an electron microscope to reveal that the carrier particles with a coverage of not less than 90% were in a content of 92% by number of the whole carrier particles, and carrier particles with a coverage of not less than 95% were in a content of 62% by number. Resistivity of the carrier particles was measured to find that it was $2\times10^{14}$ Ω·cm. Coating weight of the resin covering the coated carrier particle surfaces was also measured using a thermobalance (TGA-7, manufactured by Perkin Elmer Co.) to find that it was 2.1% by weight. Magnetic characteristics of the coated carrier particles were measured to find that $\sigma_{1,000}$ was 52 emu/cm$^3$ (packing density of sample: 3.50 g/cm$^3$).

EXAMPLE 9

To coat the magnetic ferrite carrier core particles as used in Example 1, a carrier coating solution of 5% by weight of the resin as used in Example 1 was prepared using toluene as a solvent. This coating solution was coated by spray drying to obtain coated carrier particles. The coated carrier particles thus obtained had an average particle diameter of 42 μm.

In the coated carrier particles thus obtained, the carrier particles with a resin coverage of not less than 90% were in a content of 97% by number, and carrier particles with a coverage of not less than 95% were in a content of 69% by number. Resistivity of the coated carrier particles was $8\times10^{14}$ Ω·cm. Coating weight of the resin was 2.0% by weight. $\sigma_{1,000}$ of the coated carrier particles was 51 emu/cm$^3$ (packing density of sample: 3.36 g/cm$^3$).

EXAMPLE 10

$Fe_2O_3$, CuO and ZnO were weighed in molar ratio of 50 mol %, 26 mol % and 24 mol %, respectively, which were then mixed using a ball mill.

The resulting mixture was calcined, followed by pulverization using the ball mill and then Granulation by means of a spray dryer. The resulting product was subjected to burning, further followed by classification to obtain magnetic ferrite carrier core particles. Resistivity of the magnetic carrier core particles obtained was measured to find that it was $2\times10^8$ Ω·cm.

To coat the resulting magnetic ferrite carrier core particles a carrier coating solution of 3% by weight of the resin as used in Example 1 was prepared using toluene as a solvent. This coating solution was applied to the above carrier core particles in the same manner as in Example 1. The carrier particles thus obtained were dried in the fluidized bed at a temperature of 80° C. for 1 hour to remove the solvent, and then coated carrier particles were obtained. The coated carrier particles thus obtained had an average particle diameter of 30 μm. The coated carrier thus obtained was tested in the same manner as in Example 1. As a result, the same good results as in Example 1 were obtained.

The resin coverage of the resulting coated carrier particles was measured using an electron microscope to reveal that the carrier particles with a coverage of not less than 90% were in a content of 94% by number of the whole carrier particles, and carrier particles with a coverage of not less than 95% were in a content of 63% by number. Resistivity of the carrier particles was measured to find that it was $7\times10^{14}$ Ω·cm. Coating weight of the resin covering the coated carrier particle surfaces was also measured using a thermobalance (TGA-7, manufactured by Perkin Elmer Co.) to find that it was 3.9% by weight. Magnetic characteristics of the coated carrier particles were measured to find that $\sigma_{1,000}$ was 189 emu/cm$^3$ (packing density of sample: 3.50 g/cm$^3$).

The coated carriers used in Examples are shown in Table 1(A) and Table 1(B).

Comparative Example 1

To coat the magnetic ferrite carrier core particles as used in Example 1, a carrier coating solution of 5% by weight of the resin as used in Example 1 was prepared using toluene as a solvent. This coating solution was coated on the carrier core particles while continuously applying a shear stress and evaporating the solvent. The coated carrier particles thus obtained were dried at 150° C. for 1 hour and then disintegrated, followed by classification through a 100 mesh sieve to obtain coated carrier particles. The coated carrier particles thus obtained had an average particle diameter of 42 μm.

In the coated carrier particles thus obtained, the carrier particles with a resin coverage of not less than 90% were in a content of 45% by number, and carrier particles with a coverage of not less than 95% were in a content of 10% by number. Resistivity of the coated carrier particles was $2\times10^9$ Ω·cm. Coating weight of the resin on the coated carrier particles was 1.0% by weight, and $\sigma_{1,000}$ of the coated carrier particles was 50 emu/cm$^3$ (packing density of sample: 3.36 g/cm$^3$).

The coated carrier thus obtained was tested in the same manner as in Example 1. As a result, the developer was sufficiently fed onto the developing sleeve and also solid images had a high density. However, coarse dots caused by charge leak were seen, and, in regard to halftone areas and line images, images with a very low reproduction were obtained. Also, carrier adhesion to non-image areas was seen, which was caused by the injection of charges into the coated carrier, and only images with a very poor image contrast were obtained.

Comparative Example 2

To coat the magnetic ferrite carrier core particles as used in Example 1, a carrier coating solution of 5% by weight of the resin as used in Example 1 was prepared using toluene as a solvent. This coating solution was coated using a fluidized bed type coating apparatus SPIRACOATER (trade name; manufactured by Okada Seiko K.K.) to obtain coated carrier particles. The coated carrier particles thus obtained were dried in the fluidized bed at a temperature of 140° C. for 1 hour to obtain a coated carrier. The coated carrier thus obtained had an average particle diameter of 42 μm.

In the coated carrier particles thus obtained, the carrier particles with a resin coverage of not less than 90% were in a content of 58% by number, and carrier particles with a coverage of not less than 95% were in a content of 47% by number. Resistivity of the coated carrier particles was $2\times10^{12}$ Ω·cm. Coating weight of the resin on the coated carrier particles was 2.0% by weight, and $\sigma_{1,000}$ of the coated carrier particles was 50 emu/cm$^3$ (packing density of sample: 3.36 g/cm$^3$).

The coated carrier thus obtained was tested in the same manner as in Example 1. As a result, like Comparative Example 1, toner images with a very poor image quality were obtained.

The results in Comparative Examples are also shown in Table 2.

TABLE 1

| | Core resistivity (Ω · cm) | Resin resistivity (Ω · cm) | Resin coating weight (wt. %) | $\sigma_{1,000}$ of coated carrier (emu/cm$^3$) | Coated carrier average particle diameter (μm) |
|---|---|---|---|---|---|
| Example: | | | | | |
| 1 | $2\times10^8$ | $5\times10^{14}$ | 2.0 | 52 | 41 |
| 2 | $2\times10^8$ | $2\times10^{14}$ | 2.0 | 52 | 40 |
| 3 | $2\times10^8$ | $7\times10^{13}$ | 2.0 | 52 | 41 |
| 4 | $2\times10^8$ | $5\times10^{14}$ | 4.9 | 50 | 42 |
| 5 | $2\times10^8$ | $5\times10^{14}$ | 1.7 | 45 | 65 |
| 6 | $2\times10^8$ | $4\times10^{13}$ | 2.2 | 52 | 41 |
| 7 | $2\times10^8$ | $8\times10^{14}$ | 2.1 | 52 | 41 |
| 8 | $2\times10^8$ | $2\times10^{12}$ | 2.1 | 52 | 41 |
| 9 | $2\times10^8$ | $5\times10^{14}$ | 2.0 | 51 | 42 |
| 10 | $4\times10^8$ | $5\times10^{14}$ | 3.9 | 189 | 30 |
| Comparative Example: | | | | | |
| 1 | $2\times10^8$ | $5\times10^{15}$ | 1.0 | 50 | 42 |
| 2 | $2\times10^8$ | $5\times10^{15}$ | 2.0 | 49 | 43 |

| | KP (emu/cm$^2$) | Coated carrier resistivity (Ω · cm) | Coated carrier resin coverage 90% or more (% by number) | Coated carrier resin coverage 95% or more (% by number) |
|---|---|---|---|---|
| Example: | | | | |
| 1 | 0.21 | $5\times10^{14}$ | 94 | 65 |
| 2 | 0.21 | $4\times10^{14}$ | 91 | 65 |
| 3 | 0.21 | $8\times10^{14}$ | 91 | 61 |
| 4 | 0.21 | $2\times10^{15}$ | 97 | 85 |
| 5 | 0.29 | $9\times10^{14}$ | 96 | 61 |
| 6 | 0.21 | $7\times10^{14}$ | 91 | 68 |
| 7 | 0.21 | $6\times10^{14}$ | 93 | 65 |
| 8 | 0.21 | $2\times10^{14}$ | 92 | 62 |
| 9 | 0.21 | $8\times10^{14}$ | 97 | 69 |
| 10 | 0.57 | $7\times10^{14}$ | 94 | 63 |

TABLE 1-continued

| | | | | |
|---|---|---|---|---|
| Comparative Example: | | | | |
| 1 | 0.21 | $8\times10^9$ | 45 | 10 |
| 2 | 0.21 | $2\times10^{13}$ | 58 | 37 |

TABLE 2

| | Solid black density | Dot reproduction | Coarse half-halftone areas | Line reproduction | Carrier adhesion |
|---|---|---|---|---|---|
| Example: | | | | | |
| 1 | 1.53 | AA | AA | AA | AA |
| 2 | 1.5 | AA | AA | AA | AA |
| 3 | 1.53 | AA | AA | AA | A |
| 4 | 1.49 | AA | AA | AA | AA |
| 5 | 1.55 | A | AA | AA | AA |
| 6 | 1.52 | AA | AA | AA | AA |
| 7 | 1.5 | AA | AA | AA | AA |
| 8 | 1.48 | AA | AA | AA | AA |
| 9 | — | — | — | — | — |
| 10 | 1.57 | A | A | AA | A |
| Comparative Example: | | | | | |
| 1 | 1.48 | B | B | AA | C |
| 2 | 1.45 | B | B | AA | C |

Evaluation criteria:
AA: Excellent
A: Good
B: Passable
C: Poor

EXAMPLE 11

| | |
|---|---|
| Phenol | 7% by weight |
| Formaldehyde solution (formaldehyde: about 40% by weight, methanol: about 10% by weight; balance: water) | 3% by weight |
| Magnetite powder (average particle diameter: 0.25 μm) | 90% by weight |

While the above materials were stirred in an aqueous phase using ammonia as a basic catalyst and calcium fluoride as a polymerization stabilizer, the temperature was gradually raised to 80° C. to carry out polymerization for 2 hours. The polymerization particles thus obtained were classified to obtain magnetic material disperse type resin carrier core particles.

Next, the surfaces of the carrier core particles obtained were coated with styrene/methyl methacrylate/2-ethylhexyl methacrylate copolymer resin (copolymerization ratio: 45/45/10; weight average molecular weight Mw: 50,000) in the following way.

First, to coat the core particles, a carrier coating solution of 10% by weight of the above styfane copolymer resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and also the resin coating solution was sprayed at a pressure of 4 kg/cm$^2$. Next, the coated carrier particles thus obtained were dried in the fluidized bed at a temperature of 80° C. for 1 hour to remove the solvent, and then the coated carrier particles of the present invention were obtained.

The coated carrier particles thus obtained had an average particle diameter of 40 μm and a sphericity of 1.05. The resin coverage of the resulting coated carrier particles was measured using an electron microscope to reveal that the carrier particles with a coverage of not less than 90% were in a content of 92% by number of the whole carrier particles, and carrier particles with a coverage of not less than 95% were in a content of 73% by number.

A diagrammatic view of a coated carrier particle arbitrarily sampled from the coated carrier particles obtained is shown in FIG. 1.

Resistivity of the coated carrier particles obtained was measured to find that it was $4\times10^{14}$ Ω·cm. Coating weight of the coated resin covering the carrier particle surfaces was also measured using a thermobalance (TGA-7, manufactured by Perkin Elmer Co.) to find that it was 3.0% by weight. Magnetic characteristics of the coated carrier particles obtained were measured to find that $\sigma_{1,000}$ was 130 emu/cm$^3$ (packing density of sample: 1.65 g/cm$^3$).

Physical properties of coated carriers are summarized in Table 3.

Meanwhile, the materials shown below were thoroughly premixed, and the mixture was thereafter melt-kneaded. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified by means of an elbow-jet multi-division classifier to obtain a cyan toner with a negative chargeability, having a weight average particle diameter of 7.5 μm.

| | |
|---|---|
| Polyester resin obtained by condensation of propoxylated bisphenol with fumaric acid | 100 parts by weight |
| Copper phthalocyanine pigment | 5 parts by weight |
| Chromium complex salt of di-tert-butyl-salicylic acid | 4 parts by weight |

Next, 100 parts by weight of the above cyan toner and 0.7 part by weight of a fine silica powder having been made hydrophobic by treatment with hexamethyldisilazane and 0.3 part by weight of fine alumina powder were mixed using a Henschel mixer to prepare a cyan toner having an external additive on the toner particle surfaces.

The above carrier of the present Example and the toner, thus obtained, were blended in a toner concentration of 5.5% by weight to obtain a two-component type developer.

The two-component type developer obtained was put in a modified machine of a full-color laser copying machine CLC-500, manufactured by Canon Inc., and image reproduction was tested. In this test, the distance between the developer carrying member (developing sleeve) and developer control member (non-magnetic blade) of the developing assembly was set at 600 μm, the distance between the developing sleeve and the electrostatic image bearing member (photosensitive drum) at 450 μm, the peripheral ratio of the developing sleeve to the photosenstive drum at 1.3:1, the magnetic field of development poles of the developing sleeve at 1,000 gauss, and the developing conditions at alternating electric field 1,800 Vpp and frequency 2,000 Hz.

As a result, the developer was sufficiently fed onto the developing sleeve, solid images had a high density, no coarse dots caused by charge leak were seen, and both halftone areas and line images showed good reproduction. Also, neither carrier scatter nor carrier adhesion to image areas and non-image areas caused by development of carrier was seen.

The cyan toner and the coated carrier were also blended in an environment of normal temperature and normal humidity (23° C./60% RH) in a toner concentration of 5% to obtain a two-component type developer. Next, 100 g of the two-component type developer thus obtained was put in a 250 cc polyethylene bottle, followed by shaking for 1 hour using a tumbling mixer. Thereafter, this developer was taken out and the coated carrier was observed using an electron microscope. As a result, neither separation of the coat resin nor toner spent was seen. The toner was also observed in the same way. As a result, neither falling-off nor burying of external additives of the toner was seen.

The cyan toner and the coated carrier were also blended in an environment of low temperature and low humidity (15° C./10% RH) in a toner concentration of 5% by weight to obtain a two-component type developer. In the same environment, this developer was put in a developing assembly used for CLC-500, and unloaded drive was continued for 80 minutes by external motor driving (peripheral speed: 300 rpm). Thereafter, using this developer, images were reproduced on the modified machine of CLC-500. As a result, density of solid images also was sufficiently high and reproduction at halftone areas was Good.

Results of evaluation are shown in Table 4.

EXAMPLE 12

| | |
|---|---|
| Phenol | 5% by weight |
| Formaldehyde solution (formaldehyde: about 40% by weight, methanol: about 10% by weight; balance: water) | 3% by weight |
| Magnetite powder (average particle diameter: 0.5 μm) | 92% by weight |

Using the above materials and using ammonia as a basic catalyst and calcium fluoride as a polymerization stabilizer, magnetic material disperse type resin carrier core particles were obtained in the same manner as in Example 11.

Next, the surfaces of the carrier core particles obtained were coated with styrene/2-hydroxyethyl methacrylate/methyl methacrylate copolymer resin (copolymerization ratio: 40/10/50; hydroxyl value, KOH mg/g: 30) in the following way.

A carrier coating solution of 10% by weight of the above styrene copolymer resin was prepared using toluene as a solvent. Using this coating solution, the above carrier core particles were coated in the same manner as in Example 11 to obtain the coated carrier particles of the present Example.

The coated carrier particles thus obtained had an average particle diameter of 43 μm and a sphericity of 1.04. In the coated carrier particles thus obtained, the carrier particles with a coat-resin coverage of not less than 90% were in a content of 92% by number, and carrier particles with a coverage of not less than 95% were in a content of 75% by number. Resistivity of the coated carrier particles was $4\times10^{14}$ Ω·cm. Coating weight of the resin was 3.0% by weight. $\sigma_{1,000}$ of the coated carrier particles was 135 emu/cm$^3$ (packing density of sample: 1.70 g/cm$^3$).

The coated magnetic carrier thus obtained was tested for image reproduction in the same manner as in Example 11.

As a result, as shown in Table 4, the same good results as in Example 11 were obtained.

EXAMPLE 13

| | |
|---|---|
| Phenol | 13% by weight |
| Formaldehyde solution (formaldehyde: about 40% by weight, methanol: about 10% by weight; balance: water) | 7% by weight |
| Magnetite powder (average particle diameter: 0.1 μm) | 80% by weight |

Using the above materials and using ammonia as a basic catalyst and calcium fluoride as a polymerization stabilizer, magnetic material disperse type resin carrier core particles were obtained in the same manner as in Example 11.

Next, the carrier core particles obtained were coated with a resin having the following composition, to obtain the coated carrier of the present Example.

| | |
|---|---|
| Styrene/methyl methacrylate (60/40) copolymer | 50% by weight |
| Vinylidene fluoride/tetrafluoroethylene (70/30) copolymer | 50% by weight |

A carrier coating solution of 10% by weight of the above copolymer resin was prepared using toluene as a solvent. Using this coating solution, the above carrier core particles were coated in the same manner as in Example 11 to obtain the coated carrier particles of the present invention.

The coated carrier particles thus obtained had an average particle diameter of 42 μm and a sphericity of 1.05. In the coated carrier particles thus obtained, the carrier particles with a coat-resin coverage of not less than 90% were in a content of 97% by number, and carrier particles with a coverage of not less than 95% were in a content of 85% by number. Resistivity of the coated carrier particles was $2\times10^{15}$ Ω·cm. Coating weight of the coating resin was 5.0% by weight. $\sigma_{1,000}$ of the coated carrier particles was 97 emu/cm$^3$ (packing density of sample: 1.55 g/cm$^3$).

The coated magnetic carrier thus obtained was tested in the same manner as in Example 11. As a result, as shown in Table 4, the same good results as in Example 11 were obtained.

EXAMPLE 14

| | |
|---|---|
| Phenol | 7% by weight |
| Formaldehyde solution (formaldehyde: about 40% by weight, methanol: about 10% by weight; balance: water) | 3% by weight |
| Magnetite powder (average particle diameter: 0.25 μm) | 90% by weight |

Using the above materials and using ammonia as a basic catalyst and calcium fluoride as a polymerization stabilizer, magnetic material disperse type resin carrier core particles were obtained in the same manner as in Example 11.

To coat the resulting carrier core particles, a carrier coating solution of 5% by weight of silicone resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus. Here, the resin coating solution was sprayed at a pressure of 4 kg/cm$^2$. Next, the coated carrier particles thus obtained were dried in the fluidized bed at a temperature of 120° C. for 1 hour to remove the solvent, and then the coated carrier particles of the present Example were obtained.

The coated carrier particles thus obtained had an average particle diameter of 45 μm and a sphericity of 1.05. In the coated carrier particles thus obtained, the carrier particles with a resin coverage of not less than 90% were in a content of 90% by number, and carrier particles with a coverage of not less than 95% were in a content of 85% by number. Resistivity of the coated carrier particles was $5\times10^{14}$ Ω·cm. Coating weight of the resin was 3.0% by weight. $\sigma_{1,000}$ of the coated carrier particles was 130 emu/cm$^3$ (packing density of sample: 1.66 g/cm$^3$).

The coated magnetic carrier thus obtained was tested in the same manner as in Example 11. As a result, as shown in Table 4, the same good results as in Example 11 were obtained.

EXAMPLE 15

| | |
|---|---|
| Phenol | 7% by weight |
| Formaldehyde solution (formaldehyde: about 40% by weight, methanol: about 10% by weight; balance: water) | 3% by weight |
| Magnetite powder (average particle diameter: 0.3 μm) | 55% by weight |
| Hematite powder (average particle diameter: 0.3 μm) | 45% by weight |

Using the above materials and using ammonia as a basic catalyst and calcium fluoride as a polymerization stabilizer, magnetic material disperse type resin carrier core particles were obtained in the same manner as in Example 11.

Resistivity of the carrier core particles thus obtained was measured to find that it was $2\times10^{10}$ Ω·cm. The surfaces of the carrier core particles obtained were coated so as to be in a coating weight of 3% by weight in the same manner as in Example 11 to obtain the coated magnetic carrier particles of the present Example.

The coated carrier particles thus obtained had an average particle diameter of 41 μm and a sphericity of 1.06. In the coated carrier particles thus obtained, the carrier particles with a resin coverage of not less than 90% were in a content of 93% by number, and carrier particles with a coverage of not less than 95% were in a content of 75% by number. Resistivity of the coated carrier particles was $9\times10^{14}$ Ω·cm. Coating weight of the resin was 3.0% by weight. $\sigma_{1,000}$ of the coated carrier particles was 59 emu/cm$^3$ (packing density of sample: 1.61 g/cm$^3$).

The coated magnetic carrier thus obtained was tested in the same manner as in Example 11. As a result, as shown in Table 4, the same good results as in Example 11 were obtained. The state of the developer on the developing sleeve was also observed to confirm that the ear rise of the developer was dense and the ears were short.

EXAMPLE 16

| | |
|---|---|
| Phenol | 9% by weight |
| Formaldehyde solution (formaldehyde: about 40% by weight, methanol: about 10% by weight; balance: water) | 4% by weight |
| Ni—Zn ferrite (Fe:Ni:Zn: 6:2:2; average particle diameter: 0.2 μm) | 87% by weight |

Using the above materials and using ammonia as a basic catalyst and calcium fluoride as a polymerization stabilizer, magnetic material disperse type resin carrier core particles were obtained in the same manner as in Example 11.

Resistivity of the carrier core particles thus obtained was measured to find that it was 4×109 Ω·cm.

To coat the resulting carrier core particles, a carrier coating solution of 5% by weight of silicone resin was prepared using toluene as a solvent. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and the resin coating solution was sprayed at a pressure of 4 kg/cm$^2$. The coated carrier particles thus obtained were dried in the fluidized bed at a temperature of 120° C. for 1 hour to remove the solvent, and then the coated carrier particles of the present Example were obtained.

The coated carrier particles thus obtained had an average particle diameter of 43 μm and a sphericity of 1.03. The coated magnetic carrier thus obtained was tested in the same manner as in Example 11. As a result, as shown in Table 4, the same good results as in Example 11 were obtained. The state of the developer on the developing sleeve was also observed to confirm that the ear rise of the developer was dense and the ears were short.

The resin coverage of the resulting coated carrier particles was measured using an electron microscope to reveal that the carrier particles with a coverage of not less than 90% were in a content of 94% by number of the whole carrier particles, and carrier particles with a coverage of not less than 95% were in a content of 70% by number. Resistivity of the coated carrier particles obtained was measured to find that it was 6×10$^{14}$ Ω·cm. Coating weight of the coated resin covering the carrier particle surfaces was also measured using a thermobalance (TGA-7, manufactured by Perkin Elmer Co.) to find that it was 3.0% by weight. Magnetic characteristics of the coated carrier particles were measured to find that $\sigma_{1,000}$ was 52 emu/cm$^3$ (packing density of sample: 1.64 g/cm$^3$).

EXAMPLE 17

The magnetic carrier core particles as used in Example 16 were coated so as to be in a resin coating weight of 2.5% by weight in the same manner as in Example 11 to obtain the coated magnetic carrier particles of the present Example.

The coated carrier particles thus obtained had an average particle diameter of 66 μm and a sphericity of 1.04. The coated carrier of the present Example was blended with the toner as used in Example 11 in a toner concentration of 4% by weight to produce a two-component type developer. Using this developer, tests were made in the same manner as in Example 11. As a result, the same good results as in Example 11 were obtained. The state of the developer on the developing sleeve was also observed to confirm that the ear rise of the developer was dense and the ears were short.

The resin coverage of the resulting coated carrier particles was measured using an electron microscope to reveal that the carrier particles with a coverage of not less than 90% were in a content of 94% by number of the whole carrier particles, and carrier particles with a coverage of not less than 95% were in a content of 68% by number. Resistivity of the coated carrier particles obtained was measured to find that it was 3×10$^{14}$ Ω·cm. Coating weight of the coated resin covering the carrier particle surfaces was also measured using a thermobalance (TGA-7, manufactured by Perkin Elmer Co.) to find that it was 2.5% by weight. Magnetic characteristics of the coated carrier particles were measured to find that $\sigma_{1,000}$ was 53 emu/cm$^3$ (packing density of sample: 1.60 g/cm$^3$).

EXAMPLE 18

| | |
|---|---|
| Styrene/isobutyl acrylate copolymer (copolymerization weight ratio: 80/20) | 20% by weight |
| Magnetite powder (average particle diameter: 0.4 μm) | 80% by weight |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of about 38 μm. The finely pulverized product was introduced in Mechanomill MM-10 (trade name; manufactured by Okada Seiko K.K.) to mechanically make the particles spherical. The finely pulverized particles made spherical were then classified to obtain magnetic material disperse type resin carrier core particles.

Resistivity of the carrier core particles thus obtained was measured to find that it was 2×10$^8$ Ω·cm.

To coat the resulting carrier cope particles, a carrier coating solution of 10% by weight of the same resin as used in Example 11 was prepared using toluene as a solvent, and the carrier core particles were coated in the same manner as in Example 11. The coated magnetic carrier particles of the present Example thus obtained had an average particle diameter of 34 μm and a sphericity of 1.16.

The coated magnetic carrier of the present Example was blended with the toner as used in Example 11 in a toner concentration of 6.5% by weight to produce a two-component type developer. Using this developer, tests were made in the same manner as in Example 11. As a result, as shown in Table 4, the same good results as in Example 11 were obtained.

The resin coverage of the resulting coated carrier particles was measured using an electron microscope to reveal that the carrier particles with a coverage of not less than 90% were in a content of 94% by number of the whole carrier particles, and carrier particles with s coverage of not less than 95% were in a content of 65% by number. Resistivity of the coated carrier particles obtained was measured to find that it was 9×10$^{14}$ Ω·cm. Coating weight of the coated resin covering the carrier particle surfaces was also measured using a thermobalance (TGA-7, manufactured by Perkin Elmer Co.) to find that it was 4.0% by weight. Magnetic characteristics of the coated carrier particles were measured to find that $\sigma_{1,000}$ was 103 emu/cm$^3$ (packing density of sample: 1.52 g/cm$^3$).

Comparative Example 3

$Fe_2O_3$, CuO and ZnO were weighed in molar ratio of 30 mol %, 15 mol % and 65 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic carrier core particles. Resistivity of the magnetic carrier core particles obtained was measured to find that it was $4\times10^8$ Ω·cm.

To coat the carrier core particles thus obtained, a carrier coating solution of 5% by weight of the same resin as used in Example 11 was prepared using toluene as a solvent. This coating solution was coated on the carrier core particles while continuously applying a shear stress and evaporating the solvent. The coated carrier particles thus obtained were dried at 150° C. for 1 hour and then disintegrated, followed by classification through a 100 mesh sieve to obtain coated magnetic carrier particles for comparison.

The coated carrier particles thus obtained had an average particle diameter of 43 μm and a sphericity of 1.18. In the coated carrier particles thus obtained, the carrier particles with a resin coverage of not less than 90% were in a content of 5% by number, and carrier particles with a coverage of not less than 95% were in a content of 2% by number. Resistivity of the coated carrier particles was $7\times10^{11}$ Ω·cm. Coating weight of the resin on the coated carrier particles was 1.0% by weight, and $\sigma_{1,000}$ of the coated carrier particles was 190 emu/cm$^3$ (packing density of sample: 2.54 g/cm$^3$).

The comparative coated magnetic carrier thus obtained was blended with a toner having the same composition as the one used in Example 11 and having an average particle diameter of 8.5 μm, in a toner concentration of 5% by weight to obtain a two-component type developer for comparison.

Using this developer, tests were made in the same manner as in Example 11. In this test, the distance between the developing sleeve and the magnetic blade was set at 800 μm. As a result of the test, the developer was sufficiently fed onto the developing sleeve and also solid images had a sufficient density. However, coarse dots caused by charge leak were greatly seen, and, in regard to halftone areas and line images, images with a very low reproduction were obtained. Also, the phenomenon of carrier adhesion to non-image areas was remarkable, which was caused by the injection of charges into the coated carrier, and only images with a very poor image contrast were obtained.

As a result of the shaking test made using a tumbling mixer, the separation of coating material was partly seen. Images were reproduced after the unloaded drive of the developing assembly. As a result, coarse images at halftone areas increased, and smeared images due to separation of magnetic materials were seen. The solid images had a little low density.

The results in the present Comparative Example are shown together in Table 4.

TABLE 3

| | Magnetic material | | Core | Coating resin | Resin coatting | Coated carrier | |
|---|---|---|---|---|---|---|---|
| | (1) (μm) | Amount (wt. %) | resistivity (Ω · cm) | resistivity (Ω · cm) | weight (wt. %) | $\sigma_{1,000}$ (emu/cm$^3$) | (1) (μm) |
| Example: | | | | | | | |
| 11 | 0.25 | 90 | $4\times10^8$ | $4\times10^{15}$ | 3.0 | 130 | 40 |
| 12 | 0.5 | 92 | $8\times10^8$ | $1\times10^{15}$ | 3.0 | 135 | 43 |
| 13 | 0.1 | 80 | $7\times10^7$ | $8\times10^{14}$ | 5.0 | 97 | 42 |
| 14 | 0.25 | 90 | $4\times10^8$ | $6\times10^{15}$ | 3.0 | 130 | 45 |
| 15 | 0.3/ 0.3 | 90 | $2\times10^{10}$ | $4\times10^{15}$ | 3.0 | 59 | 41 |
| 16 | 0.2 | 87 | $4\times10^9$ | $6\times10^{15}$ | 3.0 | 52 | 43 |
| 17 | 0.2 | 87 | $4\times10^9$ | $4\times10^{14}$ | 2.5 | 53 | 66 |
| 18 | 0.2 | 80 | $4\times10^{10}$ | $4\times10^{14}$ | 4.0 | 103 | 34 |
| Comparative Example: | | | | | | | |
| 3 | — | — | $4\times10^8$ | $4\times10^{15}$ | 1.0 | 190 | 43 |

| | Coated carrier particles | | | | |
|---|---|---|---|---|---|
| | Resistivity (Ω · cm) | Resin coverage ≧90% (% by number) | Resin coverage ≧95% (% by number) | Bulk density (g/cm$^3$) | Sphericity |
| Example: | | | | | |
| 11 | $4\times10^{14}$ | 92 | 73 | 1.65 | 1.05 |
| 12 | $4\times10^{14}$ | 92 | 75 | 1.7 | 1.04 |
| 13 | $2\times10^{15}$ | 97 | 80 | 1.55 | 1.05 |
| 14 | $5\times10^{14}$ | 90 | 73 | 1.66 | 1.05 |
| 15 | $9\times10^{14}$ | 93 | 75 | 1.61 | 1.06 |
| 16 | $6\times10^{14}$ | 94 | 70 | 1.64 | 1.03 |
| 17 | $3\times10^{14}$ | 92 | 68 | 1.6 | 1.04 |
| 18 | $9\times10^{14}$ | 94 | 65 | 1.52 | 1.16 |
| Comparative Example: | | | | | |
| 3 | $7\times10^{11}$ | 5 | 2 | 2.54 | 1.18 |

(1): Average particle diameter

TABLE 4

| | Solid black density | Dot reproduction | Coarse half-tone areas | Line reproduction | Carrier adhesion |
|---|---|---|---|---|---|
| | | | Initial stage | | |
| Example: | | | | | |
| 11 | 1.56 | A | A | A | AA |
| 12 | 1.53 | A | A | A | AA |
| 13 | 1.62 | A | A | A | AA |
| 14 | 1.59 | A | A | A | AA |
| 15 | 1.55 | AA | AA | AA | A |
| 16 | 1.6 | AA | AA | AA | A |
| 17 | 1.54 | AA | AA | AA | A |
| 18 | 1.5 | AA | AA | AA | A |
| Comparative Example: | | | | | |
| 3 | 1.48 | B | B | B | B |
| | | | After running | | |
| Example: | | | | | |
| 11 | 1.57 | A | AA | A | AA |
| 12 | 1.55 | A | A | A | AA |
| 13 | 1.65 | A | A | A | AA |
| 14 | 1.58 | A | A | A | AA |
| 15 | 1.56 | AA | AA | AA | A |
| 16 | 1.61 | AA | AA | AA | A |
| 17 | 1.54 | AA | AA | AA | A |
| 18 | 1.53 | AA | AA | AA | AA |
| Comparative Example: | | | | | |
| 3 | 1.46 | C | C | B | C |

Evaluation criteria:
AA: Excellent
A: Good
B: Passable
C: Poor

EXAMPLE 19

The surfaces of magnetic ferrite carrier core particles comprised of $Fe_2O_3$, CuO and ZnO (average particle diameter: 40 μm; resistivity: $2\times10^8$ Ω·cm) were coated with a carrier coating solution of 10% by weight of methoxymethylated nylon 6, prepared using methanol as a solvent, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and also the resin coating solution was sprayed at a pressure of 4 kg/cm$^2$.

The carrier particles thus obtained were dried in the fluidized bed at a temperature of 80° C. for 1 hour to remove the solvent, and then coated carrier particles were obtained. The coated carrier particles thus obtained had an average particle diameter of 41 μm.

The resin coverage of the resulting coated carrier particles was measured using an electron microscope to reveal that the carrier particles with a coverage of not less than 90% were in a content of 96% by number of the whole carrier particles, and carrier particles with a coverage of not less than 95% were in a content of 68% by number.

A diagrammatic view of a coated carrier particle arbitrarily sampled from the coated carrier particles obtained in the present Example is shown in FIG. 1. The particle is seen to be uniformly and sufficiently coated with the resin.

Resistivity of the coated carrier particles obtained was measured to find that it was $5\times10^{11}$ Ω·cm. Coating weight of the coated resin covering the carrier particle surfaces was also measured using a thermobalance (TGA-7, manufactured by Perkin Elmer Co.) to find that it was 2.0% by weight. Magnetic characteristics of the coated carrier particles were measured to find that $\sigma_{1,000}$ was 76 emu/cm$^3$ (packing density of sample: 3.50 g/cm$^3$).

Physical properties of coated carriers used in Examples are shown in Table 5.

Meanwhile, the materials shown below were thoroughly premixed, and the mixture was thereafter melt-kneaded. After cooled, the kneaded product was crushed using a hammer mill to have a particle diameter of about 1 to 2 mm. Subsequently, the crushed product was finely pulverized using a fine Grinding mill of an air-jet system. The finely pulverized product obtained was then classified by means of an elbow-jet multi-division classifier to obtain a cyan toner with a negative chargeability, having a weight average particle diameter of 7.5 μm.

| | |
|---|---|
| Polyester resin obtained by condensation of propoxylated bisphenol with fumaric acid | 100 parts by weight |
| Copper phthalocyanine pigment | 5 parts by weight |
| Chromium complex salt of di-tert-butylsalicylic acid | 4 parts by weight |

Next, 100 parts by weight of the above cyan toner and 0.7 part by weight of a fine silica powder having been made hydrophobic by treatment with hexamethyldisilazane and 0.3 part by weight of fine alumina powder were mixed using a Henschel mixer to prepare a cyan toner having an external additive on the toner particle surfaces.

The above carrier of the present Example and the toner, thus obtained, were blended in a toner concentration of 5.5% by weight to obtain a two-component type developer. This two-component type developer was put in a modified machine of a full-color laser copying machine CLC-500, manufactured by Canon Inc., and image reproduction was tested in an environment of low temperature and low humidity (15° .C/5% RH). In this test, the distance between the developer carrying member (developing sleeve) and developer control member (non-magnetic blade) of the developing assembly was set at 600 μm, the distance between the developing sleeve and the electrostatic image bearing member (photosensitive drum) at 450 μm, the peripheral ratio of the developing sleeve to the photosenstive drum at 1.3:1, the magnetic field of development poles of the developing sleeve at 1,000 gauss, and the developing conditions at alternating electric field 1,800 Vpp and frequency 2,000 Hz.

As a result, the developer was sufficiently fed onto the developing sleeve, solid images had a high density, no coarse dots caused by charge leak were seen, and both halftone areas and line images showed good reproduction. Also, neither carrier scatter nor carrier adhesion to image areas and non-image areas caused by development of carrier was seen. Also, none of variations in development efficiency and increase in image density which are presumed to be caused by carrier charge-up occurred.

The results in the present Example are shown in Table 6.

EXAMPLE 20

To coat the magnetic carrier core particles as used in Example 19, a carrier coating solution of 10% by weight of a mixed resin of ethoxymethylated nylons 6 and 66 was prepared using methanol as a solvent. With this coating solution, the above carrier core particles were coated in the same manner as in Example 19 to obtain the coated carrier particles of the present Example.

The coated carrier particles thus obtained had an average particle diameter of 40 μm. In the coated carrier particles obtained, the carrier particles with a coat-resin coverage of not less than 90% were in a content of 91% by number, and carrier particles with a coverage of not less than 95% were in a content of 63% by number. Resistivity of the coated carrier particles was $4\times10^{10}$ Ω·cm. Coating weight of the resin was 2.0% by weight.

The coated magnetic carrier thus obtained was tested in the same manner as in Example 19. As a result, as shown in Table 6, the same Good results as in Example 19 were obtained.

EXAMPLE 21

To coat the magnetic carrier core particles as used in Example 19, a carrier coating solution of 10% by weight of a mixed resin of methoxymethylated nylons 6, 66 and 610 was prepared using methanol as a solvent. With this coating solution, the carrier core particles were coated in the same manner as in Example 19 to obtain the coated carrier particles of the present Example.

The coated carrier particles thus obtained had an average particle diameter of 41 μm. In the coated carrier particles obtained, the carrier particles with a coat-resin coverage of not less than 90% were in a content of 89% by number, and carrier particles with a coverage of not less than 95% were in a content of 60% by number. Resistivity of the coated carrier particles was $8\times10^{12}$ Ω·cm. Coating weight of the resin was 2.0% by weight.

The coated magnetic carrier thus obtained was tested in the same manner as in Example 19. As a result, as shown in Table 6, the same Good results as in Example 19 were obtained.

EXAMPLE 22

To coat the magnetic carrier core particles as used in Example 19, a carrier coating solution of 5% by weight of the same resin as used in Example 19 was prepared using methanol as a solvent. With this coating solution, the carrier core particles were coated in the same manner as in Example 19 to obtain the coated magnetic carrier particles of the present Example.

The coated carrier particles thus obtained had an average particle diameter of 42 μm. In the coated carrier particles obtained, the carrier particles with a coat-resin coverage of not less than 90% were in a content of 95% by number, and carrier particles with a coverage of not less than 95% were in a content of 80% by number. Resistivity of the coated carrier particles was $2\times10^{11}$ Ω·cm. Coating weight of the resin was 4.9% by weight.

The coated magnetic carrier thus obtained was tested in the same manner as in Example 19. As a result, as shown in Table 6, the same good results as in Example 19 were obtained.

EXAMPLE 23

The surfaces of magnetic ferrite carrier core particles comprised of $Fe_2O_3$, CuO and ZnO (average particle diameter: 64 μm) were coated with the same coating resin as in Example 19 so as to be in a coating weight of 1.7% by weight to obtain the coated carrier particles of the present Example.

The coated carrier particles thus obtained had an average particle diameter of 65 μm. In the coated carrier particles obtained, the carrier particles with a coat-resin coverage of not less than 90% were in a content of 97% by number, and carrier particles with a coverage of not less than 95% were in a content of by number. Resistivity of the coated carrier particles was $9\times10^{11}$ Ω·cm. Coating weight of the resin was 1.7% by weight, and $\sigma_{1,000}$ of the coated carrier was 79 emu/cm$^3$ (packing density of sample: 3.55 g/cm$^3$).

The coated magnetic carrier thus obtained was tested in the same manner as in Example 19. As a result, as shown in Table 6, the same good results as in Example 19 were obtained.

EXAMPLE 24

To coat the same carrier core particles as used in Example 19, a carrier coating solution of 3% by weight of a resin composition having the formulation shown below was prepared using a mixed solvent of methanol and buryl alcohol (3/1) as a solvent. The surfaces of the core particles were coated with it in the following manner.

| | |
|---|---|
| Methoxymethylated nylon 6 | 75 parts by weight |
| Copolymer nylon | 25 parts by weight |

This coating solution was applied to the above carrier core particles using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and the resin coating solution was sprayed at a pressure of 4 kg/cm$^2$.

The carrier particles thus obtained were dried in the fluidized bed at a temperature of 120° C. for 1 hour to remove the solvent, and then the coated carrier particles of the present Example were obtained. The coated carrier particles thus obtained had an average particle diameter of 41 μm. The coated magnetic carrier thus obtained was tested in the same manner as in Example 19. As a result, as shown in Table 6, the same Good results as in Example 19 were obtained.

The resin coverage of the coated carrier particles obtained was measured using an electron microscope to reveal that the carrier particles with a coverage of not less than 90% were in a content of 93% by number of the whole carrier particles, and carrier particles with a coverage of not less than 95% were in a content of 64% by number.

Resistivity of the coated carrier particles obtained was measured to find that it was $7\times10^{12}$ Ω·cm. Coating weight of the coated resin covering the carrier particle surfaces was also measured using a thermobalance (TGA-7, manufactured by Perkin Elmer Co.) to find that it was 2.2% by weight.

EXAMPLE 25

To cost the same carrier core particles as used in Example 19, a carrier coating solution was prepared using a composition having the formulation shown below, end the core particles were coated with it in the following manner.

| | (by weight) |
|---|---|
| Phenol resin | 60 parts |
| Conductive ultrafine tin oxide powder | 40 parts |
| Methyl alcohol | 900 parts |

At this stage, the resistivity of a coating measured when the coating was formed from the same coating solution in a layer thickness of 3 μm was $4.5\times10^{12}$ Ω·cm. This coating solution was applied to the above carrier core particles using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and the resin coating solution was sprayed at a pressure of 4 kg/cm$^2$.

The carrier particles thus obtained were dried in the fluidized bed at a temperature of 120° C. for 1 hour to remove the solvent, and then the coated carrier particles of the present Example were obtained. The coated carrier particles thus obtained had an average particle diameter of 41 μm. The coated magnetic carrier thus obtained was tested in the same manner as in Example 19. As a result, as shown in Table 6, the same good results as in Example 19 were obtained.

The resin coverage of the coated carrier particles obtained was measured using an electron microscope to reveal that the carrier particles with a coverage of not less than 90% were in a content of 94% by number of the whole carrier particles, and carrier particles with a coverage of not less than 95% were in a content of 66% by number.

Resistivity of the coated carrier particles obtained was measured to find that it was $6\times10^{11}$ Ω·cm. Coating weight of the coated resin covering the carrier particle surfaces was also measured using a thermobalance (TGA-7, manufactured by Perkin Elmer Co.) to find that it was 2.1% by weight. Magnetic characteristics of the coated carrier particles were measured to find that $\sigma_{1,000}$ was 52 emu/cm$^3$ (packing density of sample: 3.50 g/cm$^3$).

Comparative Example 4

To coat the same carrier core particles as used in Example 19, a carrier coating solution of 5% by weight of the resin as used in Example 19 was prepared using methyl alcohol as a solvent. This coating solution was coated on the carrier core particles while continuously applying a shear stress and evaporating the solvent. The coated carrier particles thus obtained were dried at 150° C. for 1 hour and then disintegrated, followed by classification through a 100 mesh sieve to obtain coated magnetic carrier particles for comparison.

The coated carrier particles thus obtained had an average particle diameter of 42 μm. In the coated carrier particles thus obtained, the carrier particles with a resin coverage of not less than 90% were in a content of 48% by number, and carrier particles with a coverage of not less than 95% were in a content of 20% by number. Resistivity of the coated carrier particles was $2\times10^9$ Ω·cm. Coating weight of the resin was 1.0% by weight, and $\sigma_{1,000}$ of the coated magnetic carrier particles was 75 emu/cm$^3$ (packing density of sample: 3.36 g/cm$^3$).

The coated magnetic carrier thus obtained was tested in the same manner as in Example 19. As a result, the developer was sufficiently fed onto the developing sleeve and also solid images had a sufficient density. However, coarse dots caused by charge leak were greatly seen, and, in regard to halftone areas and line images, images with a very low reproduction were obtained. Also, the phenomenon of carrier adhesion to non-image areas was remarkable, which was caused by the injection of charges into the coated carrier, and only images with a very poor image contrast were obtained.

The results in the present Comparative Example are also shown in Table 6.

Comparative Example 5

To cost the same carrier core particles as used in Example 19, a carrier coating solution of 5% by weight of the resin as used in Example 19 was prepared using methyl alcohol as a solvent so as to give a coating weight of 2% by weight. This coating solution was coated using a fluidized bed type coating apparatus SPIRACOATER (trade name; manufactured by Okada Seiko K.K.) to obtain coated carrier particles. The carrier particles thus obtained were dried in the fluidized bed at a temperature of 140° C. for 1 hour to obtain a coated carrier.

The coated carrier particles obtained had an average particle diameter of 42 μm. In the coated carrier particles thus obtained, the carrier particles with a resin coverage of not less than 90% were in a content of 65% by number, and carrier particles with a coverage of not less than 95% were in a content of 51% by number. Resistivity of the coated carrier particles was $2\times10^{10}$ Ω·cm. Coating weight of the resin on the coated carrier particles was 2.0% by weight, and $\sigma_{1,000}$ of the coated magnetic carrier particles was 50 emu/cm$^3$ (packing density of sample: 3.36 g/cm$^3$).

The coated carrier thus obtained was tested in the same manner as in Example 19. As a result, as shown in Table 6, like Comparative Example 4, toner images with a very poor image quality were obtained.

TABLE 5

| | Core resistivity (Ω · cm) | Resin resistivity (Ω · cm) | Coated carrier resin coating weight (wt. %) | $\sigma_{1,000}$ of coated carrier (emu/cm$^3$) | Coated carrier average particle diameter (μm) |
|---|---|---|---|---|---|
| Example: | | | | | |
| 19 | $2\times10^8$ | $8.0\times10^{11}$ | 2.0 | 76 | 41 |
| 20 | $2\times10^8$ | $2.5\times10^{10}$ | 2.0 | 76 | 40 |
| 21 | $2\times10^8$ | $8.8\times10^{12}$ | 2.0 | 76 | 41 |
| 22 | $2\times10^8$ | $8\times10^{11}$ | 4.9 | 76 | 42 |
| 23 | $2\times10^8$ | $8.0\times10^{11}$ | 1.7 | 79 | 65 |
| 24 | $2\times10^8$ | $9.5\times10^{12}$ | 2.2 | 76 | 41 |
| 25 | $2\times10$ | $4.5\times10^{12}$ | 2.1 | 76 | 41 |
| Comparative Example: | | | | | |
| 4 | $2\times10^8$ | $8.0\times10^{11}$ | 1.0 | 75 | 42 |
| 5 | $2\times10^8$ | $8.0\times10^{11}$ | 2.0 | 75 | 43 |

| | Coated carrier resistivity (Ω · cm) | Coated carrier resin coverage 90% or more (% by number) | Coated carrier resin coverage 95% or more (% by number) |
|---|---|---|---|
| Example: | | | |
| 19 | $5\times10^{11}$ | 96 | 68 |
| 20 | $4\times10^{10}$ | 91 | 63 |
| 21 | $8\times10^{12}$ | 89 | 60 |
| 22 | $2\times10^{11}$ | 95 | 80 |

TABLE 5-continued

| | | | |
|---|---|---|---|
| 23 | $9 \times 10^{11}$ | 97 | 66 |
| 24 | $7 \times 10^{12}$ | 93 | 64 |
| 25 | $6 \times 10^{11}$ | 94 | 66 |
| Comparative Example: | | | |
| 4 | $2 \times 10^{9}$ | 48 | 20 |
| 5 | $2 \times 10^{9}$ | 65 | 51 |

TABLE 6

| | Solid black density | Dot reproduction | Coarse half-tone areas | Line reproduction | Carrier adhesion | Density increase after running |
|---|---|---|---|---|---|---|
| Example: | | | | | | |
| 19 | 1.45 | AA | AA | AA | AA | AA |
| 20 | 1.52 | AA | AA | AA | AA | AA |
| 21 | 1.48 | AA | AA | AA | A | AA |
| 22 | 1.50 | AA | AA | AA | AA | AA |
| 23 | 1.47 | A | AA | AA | AA | AA |
| 24 | 1.47 | AA | AA | AA | AA | AA |
| 25 | 1.51 | AA | AA | AA | AA | AA |
| Comparative Example: | | | | | | |
| 4 | 1.48 | B | B | AA | C | A |
| 5 | 1.45 | B | B | AA | C | A |

Evaluation criteria:
AA: Excellent
A: Good
C: Passable
D: Poor

EXAMPLE 26

| | |
|---|---|
| Phenol | 7% by weight |
| Formaldehyde solution (formaldehyde: about 40% by weight, methanol: about 10% by weight; balance: water) | 3% by weight |
| Magnetite powder (average particle diameter: 0.25 μm) | 90% by weight |

While the above materials were stirred in an aqueous phase using ammonia as a basic catalyst and calcium fluoride as a polymerization stabilizer, the temperature was gradually raised to 80° C. to carry out polymerization for 2 hours. The polymerization particles thus obtained were classified to obtain magnetic material disperse type resin carrier core particles.

To coat the surfaces of the carrier core particles thus obtained, a carrier coating solution of 10% by weight of methoxymethylated nylon 6 (resin resistivity: $5\times10^{12}$ Ω·cm) was prepared using methanol as a solvent so as to give a coating weight of 3% by weight. This coating solution was applied to the above carrier core particles, using the coating apparatus provided with a rotary bottom disk plate and an agitating blade in the zone of a fluidized bed and carrying out the coating while forming circulating flows. The above resin coating solution was sprayed in the direction perpendicular to the movement of the fluidized bed inside the apparatus, and also the resin coating solution was sprayed at a pressure of 4 kg/cm$^2$. The coated carrier particles thus obtained were dried in the fluidized bed at a temperature of 80° C. for 1 hour to remove the solvent, and then coated carrier particles were obtained. The coated carrier particles thus obtained had an average particle diameter of 40 μm and a sphericity of 1.05.

The resin coverage of the resulting coated carrier particles was measured using an electron microscope to reveal that the carrier particles with a coverage of not less than 90% were in a content of 92% by number of the whole carrier particles, and carrier particles with a coverage of not less than 95% were in a content of 73% by number.

Resistivity of the coated carrier particles obtained was also measured to find that it was $2\times10^{12}$ Ω·cm. Coating weight of the coated resin covering the carrier particle surfaces was also measured using a thermobalance (TGA-7, manufactured by Perkin Elmer Co.) to find that it was 3.0% by weight. Magnetic characteristics of the coated carrier particles obtained were measured to find that $\sigma_{1,000}$ was 130 emu/cm$^3$ (packing density of sample: 1.65 g/cm$^3$).

Meanwhile, the materials shown below were thoroughly premixed, and the mixture was thereafter melt-kneaded. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified by means of an elbow-jet multi-division classifier to obtain a cyan toner with a negative chargeability, having a weight average particle diameter of 7.5 μm.

| | |
|---|---|
| Polyester resin obtained by condensation of propoxylated bisphenol with fumaric acid | 91% by weight |
| Copper phthalocyanine pigment | 5% by weight |
| Chromium complex salt of di-tert-butylsalicylic acid | 4% by weight |

Next, 100 parts by weight of the above cyan toner and 0.7 part by weight of a fine silica powder having been made hydrophobic by treatment with hexamethyldisilazane and 0.3 part by weight of fine alumina powder were mixed using a Henschel mixer to prepare a cyan toner having an external additive on the toner particle surfaces.

The above carrier and the toner were blended in a toner concentration of 7.0% by weight to obtain a two-component type developer. This developer was put in a modified machine of a full-color laser copying machine CLC-500, manufactured by Canon Inc., and image reproduction was tested. In this test, the distance between the developer carrying member (developing sleeve) and developer control member (non-magnetic blade) of the developing assembly was set at 600 μm, the distance between the developing sleeve and the electrostatic image bearing member (photosensitive drum) at 450 μm, the peripheral ratio of the developing sleeve to the photosenstive drum at 1.3:1, the magnetic field of development poles of the developing sleeve at 1,000 gauss, and the developing conditions at alternating electric field 1,800 Vpp and frequency 2,000 Hz.

As a result, the developer was sufficiently fed onto the developing sleeve, solid images had a high density, no coarse dots caused by charge leak were seen, and both halftone areas and line images showed good reproduction. Also, carrier scatter and carrier adhesion to image areas and non-image areas caused by development of carrier were at levels of no problem.

The cyan toner and the coated carrier were blended in an environment of low temperature and low humidity L/L (15° C./10% RH) in a toner concentration of 7.0% to obtain a two-component type developer. In the same environment, this developer was put in a developing assembly used for CLC-500, and unloaded drive was continued for 80 minutes by external motor driving (peripheral speed: 300 rpm).

Thereafter, using this developer, images were reproduced on the modified machine of CLC-500. As a result, density of solid images also was sufficiently high and reproduction at halftone areas was good.

The developer was taken out of the developing assembly and the surfaces of the coated carrier particles were observed using an electron microscope. As a result, no separation of the coat resin was seen.

The results in the present Example and those in the following Examples and Comparative Examples are shown in Table 7.

EXAMPLE 27

| | |
|---|---|
| Phenol | 5% by weight |
| Formaldehyde solution (formaldehyde: about 40% by weight, methanol: about 10% by weight; balance: water) | 3% by weight |
| Magnetite powder (average particle diameter: 0.5 μm) | 92% by weight |

Using the above materials and using ammonia as a basic catalyst and calcium fluoride as a polymerization stabilizer, magnetic material disperse type resin carrier core particles were obtained in the same manner as in Example 26.

To coat the surfaces of the carrier core particles thus obtained, a carrier coating solution of 10% by weight of a mixed resin of ethoxymethylated nylons 6 and 66 (resin resistivity: $3\times10^{12}$ Ω·cm) was prepared using methanol as a solvent so as to give a coating weight of 3% by weight. This coating solution was applied to the above carrier core particles to coat them in the same manner as in Example 26 to obtain coated carrier particles. The coated carrier particles thus obtained had an average particle diameter of 43 μm and a sphericity of 1.04.

In the coated carrier particles thus obtained, the carrier particles with a coat-resin coverage of not less than 90% were in a content of 92% by number, and carrier particles with a coverage of not less than 95% were in a content of 75% by number. Resistivity of the coated carrier particles was $8\times10^{11}$ Ω·cm. Coating weight of the resin was 3.0% by weight. $\sigma_{1,000}$ of the coated carrier particles was 135 emu/$cm^3$ (packing density of sample: 1.70 g/$cm^3$).

The coated carrier thus obtained was tested in the same manner as in Example 26. As a result, as shown in Table 7, the same good results as in Example 26 were obtained.

EXAMPLE 28

| | |
|---|---|
| Phenol | 13% by weight |
| Formaldehyde solution (formaldehyde: about 40% by weight, methanol: about 10% by weight; balance: water) | 7% by weight |
| Magnetite powder (average particle diameter: 0.1 μm) | 80% by weight |

Using the above materials and using ammonia as a basic catalyst and calcium fluoride as a polymerization stabilizer, magnetic material disperse type resin carrier core particles were obtained in the same manner as in Example 26.

To coat the surfaces of the carrier core particles thus obtained, a carrier coating solution of 10% by weight of a mixed resin of methoxymethylated nylons 6, 66 and 610 (resin resistivity: $2\times10^{12}$ Ω·cm) was prepared using methanol as a solvent so as to give a coating weight of 5% by weight. This coating solution was applied to the above carrier core particles to coat them in the same manner as in Example 26 to obtain coated carrier particles. The coated carrier particles thus obtained had an average particle diameter of 42 μm and a sphericity of 1.05.

In the coated carrier particles thus obtained, the carrier particles with a coat-resin coverage of not less than 90% were in a content of 97% by number, and carrier particles with a coverage of not less than 95% were in a content of 85% by number. Resistivity of the coated carrier particles was $5\times10^{11}$ Ω·cm, and coating weight of the coating resin was 5.0% by weight. $\sigma_{1,000}$ of the coated carrier particles was 130 emu/$cm^3$ (packing density of sample: 1.55 g/$cm^3$).

The coated magnetic carrier thus obtained was tested in the same manner as in Example 26. As a result, as shown in Table 7, the same good results as in Example 26 were obtained.

EXAMPLE 29

To coat the carrier core particles as used in Example 26, a carrier coating solution was prepared using a composition having the formulation shown below, so as to give a coating weight of 2% by weight.

| | |
|---|---|
| Phenol resin | 7% by weight |
| Conductive ultrafine tin oxide powder | 3% by weight |
| Methyl alcohol | 90% by weight |

At this stage, the resistivity of a coating resin formed from the same coating solution was $4.5\times10^{12}$ Ω·cm. This coating solution was applied to the above carrier core particles to coat them in the same manner as in Example 26 to obtain coated carrier particles. The coated carrier particles thus obtained were dried in the fluidized bed at a temperature of 120° C. for 1 hour to remove the solvent, and then coated carrier particles were obtained. The coated carrier particles thus obtained had an average particle diameter of 41 μm. The coated magnetic carrier thus obtained was tested in the same manner as in Example 26. As a result, as shown in Table 7, the same good results as in Example 26 were obtained.

The resin coverage of the resulting coated carrier particles was measured using an electron microscope to reveal that the carrier particles with a coverage of not less than 90% were in a content of 94% by number of the whole carrier particles, and carrier particles with a coverage of not less than 95% were in a content of 66% by number. Resistivity of the coated carrier particles obtained was also measured to find that it was $6\times10^{11}$ Ω·cm. Coating weight of the coated resin covering the carrier particle surfaces was also measured using a thermobalance (TGA-7, manufactured by Perkin Elmer Co.) to find that it was 2.1% by weight. Magnetic characteristics of the coated carrier particles obtained were measured to find that $\sigma_{1,000}$ was 130 emu/$cm^3$ (packing density of sample: 1.60 g/$cm^3$).

EXAMPLE 30

To a solution prepared by dissolving 2.8 parts by weight of poly(oxypropyl)triol (hydroxyl value: 148.9 KOH mg/g; weight average molecular weight: 1,470) and 0.02 part by weight of dibutyltin dilaurate in 80 parts by weight of methyl ethyl ketone, 5.5 parts by weight of a ketoxyme block copolymer of hexamethylene diisocyanate (effective NCO: 11.6% by weight) was added to prepare a carrier coating solution so as for the molar ratio of NCO groups to OH groups to be 1.2. The resistivity of a coating resin formed from this coating solution was $3\times10^{12}$ Ω·cm. This coating solution was applied to the above carrier core particles in the same manner as in Example 26 so as to be in a coating weight of 2.5% by weight. The carrier particles thus obtained were dried in the fluidized bed at a temperature of 150° C. for 40 minutes to remove the solvent, and then coated carrier particles were obtained. The coated carrier particles thus obtained had an average particle diameter of 42 μm. The coated magnetic carrier obtained was tested in the same manner as in Example 26. As a result, as shown in Table 7, the same good results as in Example 26 were obtained.

The resin coverage of the resulting coated carrier particles was measured using an electron microscope to reveal that the carrier particles with a coverage of not less than 90% were in a content of 92% by number of the whole carrier particles, and carrier particles with a coverage of not less than 95% were in a content of 70% by number. Resistivity of the coated carrier particles obtained was also measured to find that it was $8\times10^{11}$ Ω·cm. Coating weight of the coated resin covering the carrier particle surfaces was also measured using a thermobalance (TGA-7, manufactured by Perkin Elmer Co.) to find that it was 2.3% by weight. Magnetic characteristics of the coated carrier particles obtained were measured to find that $\sigma_{1,000}$ was 132 emu/cm$^3$ (packing density of sample: 1.58 g/cm$^3$).

Comparative Example 6

To coat the carrier core particles as used in Example 26, a carrier coating solution of 5% by weight of the resin as used in Example 26 was prepared using methyl alcohol as a solvent so as to give a coating weight of 2.5% by weight. This coating solution was coated using a fluidized bed type coating apparatus SPIRACOATER (trade name; manufactured by Okada Seiko K.K.) to obtain coated carrier particles. The carrier particles thus obtained were dried in the fluidized bed at a temperature of 140° C. for 1 hour to obtain a coated carrier. The coated carrier particles obtained had an average particle diameter of 42 μm.

In the coated carrier particles thus obtained, the carrier particles with a resin coverage of not less than 90% were in a content of 65% by number, and carrier particles with a coverage of not less than 95% were in a content of 51% by number. Resistivity of the coated carrier particles was $2\times10^{11}$ Ω·cm. Coating weight of the resin on the coated carrier particles was 2.3% by weight, and $\sigma_{1,000}$ of the coated magnetic carrier particles was 130 emu/cm$^3$ (packing density of sample: 1.64 g/cm$^3$).

The coated carrier thus obtained was blended with a toner having the same composition as the one used in Example 26 and having an average particle diameter of 8.5 μm, in a toner concentration of 7.0% by weight, and the developer thus obtained was tested in the same manner as in Example 26. As a result, the developer was sufficiently fed onto the developing sleeve and also solid images had a sufficient density. However, coarse dots caused by charge leak were seen, and, in regard to halftone areas and line images, images with a low reproduction were obtained. Also, carrier adhesion to non-image areas was remarkable, which was caused by the injection of charges into the coated carrier.

Comparative Example 7

$Fe_2O_3$, CuO and ZnO were weighed in molar ratio of 30 mol %, 15 mol % and 65 mol %, respectively, which were then mixed using a ball mill.

The resulting mixture was calcined, followed by pulverization using the ball mill and then granulation by means of a spray dryer. The resulting product was subjected to burning, further followed by classification to obtain magnetic ferrite carrier core particles. Resistivity of the magnetic carrier core particles obtained was measured to find that it was $4\times10^{8}$ Ω·cm.

To coat the carrier core particles thus obtained, a carrier coating solution of 5% by weight of the same resin as used in Example 26 was prepared using methyl alcohol as a solvent so as to give a coating weight of 3.5% by weight. This coating solution was coated in the same manner as in Comparative Example 5, followed by drying to obtain coated carrier particles. The coated carrier particles thus obtained had an average particle diameter of 42 μm.

In the coated carrier particles thus obtained, the carrier particles with a resin coverage of not less than 90% were in a content of 72% by number, and carrier particles with a coverage of not less than 95% were in a content of 60% by number. Resistivity of the coated carrier particles was $4\times10^{11}$ Ω·cm. Coating weight of the resin on the coated carrier particles was 3% by weight, and $\sigma_{1,000}$ of the coated carrier particles was 52 emu/cm$^3$ (packing density of sample: 3.21 g/cm$^3$).

The coated carrier thus obtained was tested in the same manner as in Example 26. As a result, as shown in Table 7, images with a poor image quality were obtained as in Comparative Example 6.

After the unloaded drive of the developing assembly in the environment of L/L, carried out in the same manner as in Example 26, the developer was observed using an electron microscope. As a result, the separation of coat resin was partly seen, which was chiefly remarkable at angular portions of the carrier particles. Images were also reproduced after the unloaded drive of the developing assembly. As a result, coarse images at halftone areas increased, and smeared images due to separation of magnetic materials were seen. A solid black density was slightly decreased.

TABLE 7

| | Initial stage | | | | |
|---|---|---|---|---|---|
| | Solid black density | Dot reproduction | Coarse half-tone areas | Line reproduction | Carrier adhesion |
| Example: | | | | | |
| 26 | 1.51 | AA | AA | AA | A |
| 27 | 1.48 | AA | AA | AA | A |
| 28 | 1.52 | AA | AA | AA | A |
| 29 | 1.55 | A | A | AA | A |
| 30 | 1.53 | A | A | AA | A |
| Comparative Example: | | | | | |
| 6 | 1.52 | B | B | B | B |
| 7 | 1.55 | B | B | C | C |

| | After running | | | | | |
|---|---|---|---|---|---|---|
| | Solid black density | Dot reproduction | Coarse half-tone areas | Line reproduction | Carrier adhesion | Coat separation |
| Example: | | | | | | |
| 26 | 1.52 | AA | AA | AA | A | AA |
| 27 | 1.5 | AA | AA | AA | A | A |
| 28 | 1.52 | AA | AA | AA | A | A |

TABLE 7-continued

| | | | | | | |
|---|---|---|---|---|---|---|
| 29 | 1.55 | A | A | AA | A | AA |
| 30 | 1.53 | A | A | AA | A | AA |
| Comparative Example: | | | | | | |
| 6 | 1.53 | B | B | B | B | A |
| 7 | 1.4 | C | C | C | C | C |

Evaluation criteria:
AA: Excellent
A: Good
B: Passable
C: Poor

What is claimed is:

1. A carrier for use in electrophotography, comprising carrier particles, wherein;

said carrier particles each comprise a carrier core particle having a resistivity of $7\times10^7$ Ωcm to $4\times10^{10}$ Ωcm and a resin for coating the carrier core particle and having a resistivity of $10^{10}$ Ωcm or above under conditions of a temperature of 23° C. and a humidity of 50% RH;

said carrier particles have an average particle diameter of not larger than 100 μm;

said carrier particles have a resistivity of $10^{10}$ Ωcm or above; and said carrier particles comprise not less than 80% by number of resin-coated carrier particles whose carrier core particles are each coated with a resin in a coverage of not less than 90%.

2. The carrier according to claim 1, wherein said resin has a resistivity of $10^{13}$ Ω·cm or above, and said carrier particles have a resistivity of $10^{12}$ Ω·cm or above.

3. The carrier according to claim 1, wherein said carrier particles comprise not less than 90% by number of the resin-coated carrier particles having the resin coverage of not less than 90%.

4. The carrier according to claim 1, wherein said carrier particles comprise not less than 60% by number of resin-coated carrier particles having a resin coverage of not less than 95%.

5. The carrier according to claim 1, wherein said carrier particles have an average particle diameter of from 10 μm to 60 μm.

6. The carrier according to claim 1, wherein said carrier core particle comprises a magnetic material having a resistivity of from $10^5$ Ω·cm to $10^{10}$ Ω·cm.

7. The carrier according to claim 6, wherein said magnetic material has a resistivity of from $10^5$ Ω·cm to $10^9$ Ω·cm.

8. The carrier according to claim 1, wherein said carrier core particle is a magnetic material disperse type resin core particle.

9. The carrier according to claim 1, wherein said carrier core particle is coated with the resin in a coating weight of from 0.5% by weight to 15% by weight.

10. The carrier according to claim 9, wherein said carrier core particle is coated with the resin in a coating weight of from 0.6% by weight to 10% by weight.

11. The carrier according to claim 1, wherein said carrier core particle is coated with the resin so as to satisfy the following expression:

$$2.5/X \leqq \text{resin coating weight (\% by weight)} \leqq 75/X$$

wherein X represents a true specific gravity of carrier core particles.

12. The carrier according to claim 11, wherein said carrier core particle is coated with the resin so as to satisfy the following expression:

$$3/X \leqq \text{resin coating weight (\% by weight)} \leqq 50/X.$$

13. The carrier according to claim 1, wherein said carrier particles have a magnetization intensity of from 30 emu/cm$^3$ to 250 emu/cm$^3$ at 1,000 oersteds.

14. The carrier according to claim 13, wherein said carrier particles have a magnetization intensity of from 40 emu/cm$^3$ to 250 emu/cm$^3$ at 1,000 oersteds.

15. The carrier according to claim 14, wherein said carrier particles have a magnetization intensity of from 40 emu/cm$^3$ to 100 emu/cm$^3$ at 1,000 oersteds.

16. The carrier according to claim 1, wherein said carrier particles satisfy the following condition.

$$0.08 \text{ emu/cm}^2 < KP < 1.0 \text{ emu/cm}^2$$

wherein KP represents an image quality improvement parameter KP=I×D; wherein I represents a magnetizing force in a unit of emu/cm$^3$ of a magnetic material used in the carrier, and D represents carrier particle diameter in a unit of cm.

17. The carrier according to claim 16, wherein said carrier particles satisfy the following condition.

$$0.1 \text{ emu/cm}^2 < KP < 0.8 \text{ emu/cm}^2.$$

18. The carrier according to claim 1, wherein said carrier particles has a sphericity SF-1 of 2 or below.

19. A process for producing a carrier, comprising: the steps of;

forming a fluidized bed of carrier core particles having a resistivity of $7\times10^7$ Ωcm to $4\times10^{10}$ Ωcm in a tubular body by the aid of a gas flow ascending inside the tubular body; and spraying a coating resin solution in the direction perpendicular to or substantially perpendicular to the direction the carrier core particles ascend in the fluidized bed;

said coating resin solution being sprayed at a spray pressure of 1.5 kg/cm$^2$ or above; to produce a resin-coated carrier, wherein;

said carrier comprises carrier particles;

said carrier particles each comprise a carrier core particle and a resin for coating the carrier core particle and having a resistivity of $10^{10}$ Ωcm or above under conditions of a temperature of 23° C. and a humidity of 50% RH;

said carrier particles have an average particle diameter of not larger than 100 μm;

said carrier particles have a resistivity of $10^{10}$ Ωcm or above; and said carrier particles comprise not less than 80% by number of resin-coated carrier particles whose carrier core particles are each coated with a resin in a coverage of not less than 90%.

20. The process according to claim 19, wherein said carrier core particles are sprayed with said resin solution while being agitated by a rotary bottom disk plate and an agitating blade which are provided at the bottom of said tubular body.

21. The process according to claim 20, wherein said rotary bottom disk plate has a mesh, and air is blown off through the mesh to fluidize said carrier core particles.

22. A two-component developer for developing an electrostatic image, comprising toner particles and carrier particles, wherein;

said toner particles have a weight average particle diameter of not larger than 10 μm;

said carrier particles each comprise a carrier core particle having a resistivity of $7\times10^7$ Ωcm to $4\times10^{10}$ Ωcm and a resin for coating the carrier core particle and having a resistivity of $10^{10}$ Ωcm or above under conditions of a temperature of 23° C. and a humidity of 50% RH;

said carrier particles have an average particle diameter of not larger than 100 μm;

said carrier particles have a resistivity of $10^{10}$ Ωcm or above; and said carrier particles comprise not less than 80% by number of resin-coated carrier particles whose carrier core particles are each coated with a resin in a coverage of not less than 90%.

23. A two-component type developer for developing an electrostatic image, comprising toner particles and carrier particles wherein said toner particles have a weight average particle diameter of not larger than 10 microns and wherein said carrier particles are a carrier according to any one of claims 2 to 18.

24. The two-component type developer according to claim 23, wherein said toner particles have a weigh average particle diameter of from 3 μm to 8 μm.

25. The two-component type developer according to claim 22, wherein said toner particles are contained in said developer in a concentration of from 1% by weight to 20% by weight.

26. The two-component type developer according to claim 25, wherein said toner particles are contained in said developer in a concentration of from 1% by weight to 10% by weight.

27. An image forming method comprising:

forming an electrostatic image on an electrostatic image bearing member;

forming on a developer carrying member a magnetic brush formed of a two-component developer; and developing the electrostatic image through the magnetic brush while applying a bias voltage to the developer carrying member, to form a toner image;

wherein;

said two-component developer comprises toner particles and magnetic carrier particles;

said toner particles have weight average particle diameter of not larger than 10 μm;

said carrier particles each comprise a carrier core particle having a resistivity of $7\times10^7$ Ωcm to $4\times10^{10}$ Ωcm and a resin for coating the carrier core particle and having a resistivity of $10^{10}$ Ωcm or above under conditions of a temperature of 23° C. and a humidity of 50% RH;

said carrier particles have an average particle diameter of not larger than 100 μm;

said carrier particles have a resistivity of $10^{10}$ Ωcm or above; and said carrier particles comprise not less than 80% by number of resin-coated particles whose carrier core particles are each coated with a resin in a coverage of not less than 90%.

28. The image forming method according to claim 27, wherein an alternating voltage is applied to said developer carrying member.

29. The image forming method according to claim 28, wherein said alternating voltage has a Vpp of from 1,000 to 10,000.

30. The image forming method according to claim 29, wherein said alternating voltage has a Vpp Of from 2,000 to 8,000.

31. The process according to claim 19, wherein said resin has a resistivity of $10^{13}$ Ωcm or above, and said carrier particles have a resistivity of $10^{12}$ Ωcm or above.

32. The process according to claim 19, wherein said carrier particles comprise not less than 90% by number of the resin-coated carrier particles having the resin coverage of not less than 90%.

33. The process according to claim 19, wherein said carrier particles comprise not less than 60% by number of resin-coated carrier particles having a resin coverage of not less than 95%.

34. The process according to claim 19, wherein said carrier particles have an average particle diameter of from 10 μm to 60 μm.

35. The process according to claim 19, wherein said carrier core particle comprises a magnetic material having a resistivity of from $10^5$ Ωcm to $10^{10}$ Ωcm.

36. The process according to claim 35, wherein said magnetic material has a resistivity of from $10^5$ Ωcm to $10^9$ Ωcm.

37. The process according to claim 19, wherein said carrier core particle is a magnetic material dispersed resin core particle.

38. The process according to claim 19, wherein said carrier core particle is coated with the resin in a coating weight from 0.5% by weight to 15% by weight.

39. The process according to claim 38, wherein said carrier core particle is coated with the resin in a coating weight from 0.6% by weight to 10% by weight.

40. The process according to claim 19, wherein said carrier core particle is coated with the resin so as to satisfy the following expression:

$$2.5/X \leqq \text{resin coating weight (\% by weight)} \leqq 75/X$$

wherein X represents a true specific gravity of carrier core particles.

41. The process according to claim 40, wherein said carrier core particle is coated with the resin so as to satisfy the following expression:

$$3/X \leqq \text{resin coating weight (\% by weight)} \leqq 50/X.$$

42. The process according to claim 19, wherein said carrier particles have a magnetization intensity of from 30 emu/cm$^3$ to 250 emu/cm$^3$ at 1,000 oersteds.

43. The process according to claim 42, wherein said carrier particles have a magnetization intensity of from 40 emu/cm$^3$ to 250 emu/cm$^3$ at 1,000 oersteds.

44. The process according to claim 43, wherein said carrier particles have a magnetization intensity of from 40 emu/cm$^3$ to 100 emu/cm$^3$ at 1,000 oersteds.

45. The process according to claim 19, wherein said carrier particles satisfy the following condition:

$$0.08 \text{ emu/cm}^2 < KP < 1.0 \text{ emu/cm}^2$$

wherein KP represents an image quality improvement parameter KP=I×D; wherein I represents a magnetizing force in a unit of emu/cm$^3$, of a magnetic material used in the carrier, and D represents carrier particle diameter in a unit of cm.

46. The process according to claim 45, wherein said carrier particles satisfy the following condition:

$$0.1 \text{ emu/cm}^2 < KP < 0.8 \text{ emu/cm}^2.$$

47. The process according to claim 19, wherein said carrier particles have a sphericity SF-1 of 2 or below.

48. The image forming method according to claim 27, wherein said resin has a resistivity of $10^{13}$ Ωcm or above, and said carrier particles have a resistivity of $10^{12}$ cm or above.

49. The image forming method according to claim 27, wherein said carrier particles comprise not less than 90% by number of the resin-coated carrier particles having the resin coverage of not less than 90%.

50. The image forming method according to claim 27, wherein said carrier particles comprise not less than 60% by number of resin-coated carrier particles having a resin coverage of not less than 95%.

51. The image forming method according to claim 27, wherein said carrier particles have an average particle diameter of from 10 μm to 60 μm.

52. The image forming method according to claim 27, wherein said carrier core particle comprises a magnetic material having a resistivity of from $10^5$ Ωcm to $10^{10}$ Ωcm.

53. The image forming method according to claim 52, wherein said magnetic material has a resistivity of from cm to $10^9$ Ωcm.

54. The image forming method according to claim 27, wherein said carrier core particle is a magnetic material dispersed resin core particle.

55. The image forming method according to claim 27, wherein said carrier core particle is coated with the resin in a coating weight of from 0.5% by weight to 15% by weight.

56. The image forming method according to claim 55, wherein said carrier core particle is coated with the resin in a coating weight of from 0.6% by weight to 10% by weight.

57. The image forming method according to claim 27, wherein said carrier core particle is coated with the resin so as to satisfy the following expression:

$$2.5/X \leqq \text{resin coating weight (\% by weight)} \leqq 75/X$$

wherein X represents a true specific gravity of carrier core particles.

58. The image forming method according to claim 57, wherein said carrier core particle is coated with the resin so as to satisfy the following expression:

$$3/X \leqq \text{resin coating weight (\% by weight)} \leqq 50/X.$$

59. The image forming method according to claim 27, wherein said carrier particles have a magnetization intensity from 30 emu/cm$^3$ to 250 emu/cm$^3$ at 1,000 oersteds.

60. The image forming method according to claim 59, wherein said carrier particles have a magnetization intensity from 40 emu/cm$^3$ to 250 emu/cm$^3$ at 1,000 oersteds.

61. The image forming method according to claim 60, wherein said carrier particles have a magnetization intensity from 40 emu/cm$^3$ to 100 emu/cm$^3$ at 1,000 oersteds.

62. The image forming method according to claim 27, wherein said carrier particles satisfy the following condition:

$$0.08 \text{ emu/cm}^2 < KP < 1.0 \text{ emu/cm}^2$$

wherein KP represents an image quality improvement parameter KP=I×D; wherein I represents a magnetizing force in a unit of emu/cm$^3$ of a magnetic material used in the carrier and D represents carrier particle diameter in a unit of cm.

63. The image forming method according to claim 62, wherein said carrier particles satisfy the following condition:

$$0.1 \text{ emu/cm}^2 < KP < 0.8 \text{ emu/cm}^2.$$

64. The image forming method according to claim 27, wherein said carrier particles have a sphericity SF-1 of 2 or below.

65. The image forming method according to claim 27, wherein said toner particles have a weight average particle diameter of from 3 μm to 8 μm.

* * * * *

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 1

Line 48, "especially" should be deleted.

COLUMN 2

Line 3, "particles" should read --particles'--.
Line 24, "used" should read --use--.
Line 34, "a" should be deleted.
Line 38, "higher" should read --high--.
Line 40, "are" should read --have been--.
Line 59, "of" should read --of a--.

COLUMN 3

Line 63, "in a good" should read --with high--.

COLUMN 4

Line 16, "of;" should read --of:--.
Line 40, "still" should be deleted.

COLUMN 5

Line 51, "whole" should read --total--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 6

Line 1, "non-uniform to cause" should read --non-uniform, causing--.
Line 11, "Such phenomena have been found to greatly depends" should read --Such a phenomenon has been found to greatly depend--.
Line 43, "Giving" should read --giving--.
Line 48, "are" should read --and which are--.

COLUMN 7

Line 1, "aimed" should read --desired--.
Line 35, "element" should read elements--.

COLUMN 8

Line 18, "hazole," should read --bazole--.
Line 31, "one another" should be deleted.
Line 36, "makes small" should read --minimizes--.
Line 37, "one another" should be deleted.
Line 37, "one another" should be deleted.

COLUMN 9

Line 35, "resin describe" should read --resins described--.
Line 36, "combination of any of them." should read --any combination--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 10

Line 13, "Glyptal" should read --glyptal--.
Line 59, "of;" should read --of:--.
Line 67, "well" should be deleted.

COLUMN 11

Line 40, "other" should read --another--.
Line 45, "adhered" should read --adhered to--.
Line 61, "is" should read --are--.

COLUMN 12

Line 11, "carrier" should read --the carrier--.
Line 24, "larger" should be deleted.

COLUMN 13

Line 39, "methecrylonitrile end" should read --methacrylonitrile and--.

COLUMN 14

Line 25, "agent" should read --agents--.
Line 37, "add in" should read --added to--.
Line 39, "one another" should be deleted.
Line 41, "As the fine powder" should read --Of the fine powders--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 15

Line 62, "cope" should read --core--.

COLUMN 16

Line 22, "s" should read --a--.
Line 26, "well densly" should read --densely--.
Line 28, "densly" should read --densely--.

COLUMN 17

Line 27, "poles of" should read --poles, including--.
Line 66, "serve" should read --serves--.

COLUMN 18

Line 21, "adhered" should read --adhere--.
Line 42, "preferably" should read --more preferably--.

COLUMN 19

Line 43, "cooled," should read --cooling,--.

COLUMN 21

Line 19, "Good" should read --good--.
Line 27, "Granulation" should read --granulation--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 23

Line 31, "Good" should read --good--.

COLUMN 24

Line 2, "Granulation" should read --granulation--.

COLUMN 25

Table 1, "Table 1" should read --Table 1(A)--.
Line 51, insert --Table 1(B)--.

COLUMN 26

Line 15, "half" should be deleted.
Line 61, "styfane" should read --styrene--.

COLUMN 27

Line 31, "cooled," should read --cooling--.

COLUMN 28

Line 29, "Good" should read --good--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 32

Line 20, "cooled," should read --cooling--.
Line 34, "cope" should read --core--.
Line 52, "s" should read --a--.

COLUMN 34

Table 2, "coatting" should read --coating--.

COLUMN 35

Table 4, "AA". should read --A --.

COLUMN 36

Line 13, "cooled," should be --cooling--.
Line 16, "Grinding" should read --grinding--.
Line 42, ".C/5%" should read --C./5%--.

COLUMN 37

Line 15, "Good" should read --good--.
Line 37, "Good" should read --good--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 38

Line 8, "of by" should read --of 66% by--.
Line 23, "buryl" should read --butyl--.
Line 46, "Good" should read --good--.
Line 64, "cost" should read --coat--.
Line 66, "end" should read --and--.

COLUMN 40

Line 13, "cost" should read --coat--.
Table 5, "2x10" should read --$2x10^8$--.

COLUMN 42

Line 17, "cooled," should read --cooling,--.

COLUMN 48

Line 26, "has" should read --have--.
Line 27, "comprising:" should read --comprising--.
Line 28, "steps of;" should read --steps of:--.

COLUMN 49

Line 18, "are a carrier" should read --are--.
Line 66, "Of" should read --of--.

UNITED STATES PATENT AND TRADEMARK OFFICE

CERTIFICATE OF CORRECTION

PATENT NO. : 5,573,880

DATED : November 12, 1997

INVENTOR(S) : SHINYA MAYAMA ET AL.

It is certified that error appears in the above-identified patent and that said Letters Patent is hereby corrected as shown below:

COLUMN 50

Line 6, "the" should read --a--.

COLUMN 51

Line 20, "cm" should read --$10^5$ Ω·cm--.

COLUMN 52

Line 32, "SF-1" should read --SF-1--.

Signed and Sealed this

Twenty-second Day of July, 1997

Bruce Lehman

*Attest:*

BRUCE LEHMAN

*Attesting Officer*

*Commissioner of Patents and Trademarks*